US006769878B1

(12) United States Patent
Parker et al.

(10) Patent No.: US 6,769,878 B1
(45) Date of Patent: Aug. 3, 2004

(54) TURBINE BLADE AIRFOIL

(75) Inventors: David G. Parker, Palm Beach Gardens, FL (US); Jeffrey S. Taylor, Stuart, FL (US); Christopher Johnston, Stuart, FL (US); J. Page Strohl, Tequesta, FL (US)

(73) Assignee: Power Systems Mfg. LLC, Jupiter, FL (US)

( * ) Notice: Subject to any disclaimer, the term of this patent is extended or adjusted under 35 U.S.C. 154(b) by 0 days.

(21) Appl. No.: 10/434,691

(22) Filed: May 9, 2003

(51) Int. Cl.[7] ..... F01D 5/14; F01D 5/18

(52) U.S. Cl. ..... 416/243; 416/223 A; 416/DIG. 2; 416/92; 416/97 R; 416/241 R; 416/241 B

(58) Field of Search ..... 416/223 R, 223 A, 416/243, DIG. 2, DIG. 5, 92, 97 R, 241 R, 241 B; 415/191, 192, 208.1, 208.2, 211.2, 115

(56) References Cited

U.S. PATENT DOCUMENTS 3,928,026 A * 12/1975 Hecht et al. ..... 416/241 R
5,980,209 A 11/1999 Barry et al.
6,129,991 A * 10/2000 Warnes et al. ..... 416/241 B
6,450,770 B1 * 9/2002 Wang et al. ..... 416/223 A
6,461,110 B1 * 10/2002 By et al. ..... 416/223 A
6,474,948 B1 * 11/2002 Pirolla et al. ..... 416/243
6,503,059 B1 * 1/2003 Frost et al. ..... 416/223 A
6,685,434 B1 * 2/2004 Humanchuk et al. ... 416/223 A
6,715,990 B1 * 4/2004 Arness et al. ..... 416/223 A

OTHER PUBLICATIONS

Wilson, D.G. et al, "The Design and Peformance Prediction of Axial Flow Turbines", The Design of Gas Turbine Engines Thermodynamics and Aerodynamics 2nd Ed, 1995, pp. 185–200, IGT1–ASME.
Ainley & Matheson, "A Method of Performance Estimation for Avial Flow Turbines", Aeronautical Research Council Report No. 2974, 1957, pp. 1–30.
Dunham & Came, "Improvements to the Ainley—Mathieson Method of Turbine Performance Prediction", Journal of Engineering for Power, Jul. 1970, pp. 252–256.
Kacker & Okapuu, "A Mean Line Prediction Method for Axial Flow Turbine Efficiency", Journal of Engineering for Power vol. 104, Jan. 1982, pp. 111–119.
Pritchard, "An Eleven Parameter Axial Turbine Airfoil Geometry Model" ASME Paper 85–GT–219, Mar. 1985.

* cited by examiner

*Primary Examiner*—Christopher Verdier
(74) *Attorney, Agent, or Firm*—Brian R. Mack

(57) ABSTRACT

A turbine blade including an airfoil having a profile in accordance with Table 1 is disclosed. The turbine blade has a plurality of cooling passages extending radially outward through the airfoil. The aerodynamic profile of the airfoil has been reconfigured to further reduce overall heat load to the airfoil while paying particular attention to the leading edge region. Specifically, the airfoil leading edge, which is the life-limiting location of the turbine blade has been reconfigured to lower heat load and allow for increased cooling, thereby increasing turbine blade life.

12 Claims, 5 Drawing Sheets

TURBINE BLADE AIRFOIL

BACKGROUND OF THE INVENTION

1. Field of the Invention

The present invention generally relates to a turbine blade for a gas turbine engine and more specifically to an improved airfoil profile having reduced heat load to the airfoil leading edge resulting in improved life.

2. Description of Related Art

As the demand for more efficient turbine engines continues to increase, higher firing temperatures are required in order to optimize turbine performance. This, in turn, requires enhanced airfoil configurations to accommodate these higher firing temperatures. Known airfoil failure modes, such as creep, which is when an airfoil is exposed to high operating temperatures and a given stress level for an extended period of time, are being addressed through redesigns involving enhanced cooling to reduce airfoil operating temperatures. Further enhancements have also been made to address performance issues caused by boundary layer flow separation. Early turbine blade technology often had airfoils with a blunt or rounded leading edge. A rounded leading edge had a constant radius of curvature, which made for an abrupt transition to the pressure side and suction side of the airfoil body, due to the discontinuous radii of curvature for each surface when compared to the constant radius of curvature of the leading edge. This transition section created regions of rapid acceleration followed by deceleration resulting in performance loss by the turbine blade. To correct this transition, some airfoil designers chose to provide an airfoil having a sharper leading edge, as disclosed in U.S. Pat. No. 5,980,209, and hereby incorporated by reference. The sharper leading edge contained a more elliptical shape that provided a smoother transition to the pressure side and suction side surfaces, thereby reducing the amount of overspeed and improving performance.

While enhancements have typically focused on lowering operating temperatures of the airfoil to increase creep margin and airfoil life as well as to address minor performance issues, there are other failure modes that must be addressed when enhancements are made to an airfoil. One specific area that should be addressed is the "heat load", of the airfoil leading edge. Heat load is defined as the product of the heat transfer coefficient for a particular airfoil design and the relevant airfoil surface area. While changing the airfoil leading edge to a more elliptical design smooths the transition to the pressure side and suction side surfaces of the airfoil, it has been determined that the heat load experienced by the airfoil leading edge is adversely impacted. Due to the geometry changes, the airfoil leading edge is more difficult to cool than the rounded leading edge configuration of the prior art, resulting in increased heat load. If too large of a heat load is experienced by a specific region of the airfoil, such as the leading edge, it can cause a life limiting condition to be present.

Therefore, what is needed is an airfoil design that incorporates performance and life enhancements of the prior art while minimizing heat load to the leading edge.

SUMMARY AND OBJECTS OF THE INVENTION

In accordance with the present invention, there is provided a novel and improved airfoil having improved performance and reduced operating temperatures for increased creep life, while simultaneously minimizing the amount of heat load experienced by the airfoil leading edge, thereby extending airfoil life. To accomplish this, airfoil geometry is disclosed that contains a semi-elliptical leading edge allowing sufficient cooling to reduce exposure of the leading edge to excessive heat, while maintaining the flow benefits of the transition between an elliptical leading edge and the pressure side and suction side surface curvatures.

In the preferred embodiment of the present invention, an airfoil for a turbine blade having an attachment with a platform extending radially outward from the attachment is disclosed with the airfoil having an uncoated profile substantially in accordance with Cartesian coordinate values of X, Y, and Z as set forth in Table 1, carried only to three decimal places, wherein Z is a distance measured radially from the platform to which the airfoil is mounted.

In an effort to reduce the overall blade heat load, the turbine blade containing the disclosed airfoil geometry contains a reconfigured leading edge, pressure side surface, and suction side surface as well as a plurality of radially extending holes for passing a cooling medium through the airfoil. The cooling medium can vary depending on engine conditions, but is typically compressed air or steam. To protect the airfoil surfaces from oxidation a metallic coating is applied.

It is an object of the present invention to provide a turbine blade having a novel and improved airfoil geometry with improved performance, lower heat load to the airfoil leading edge, enhanced cooling, increased creep margin, and extended life.

In accordance with these and other objects, which will become apparent hereinafter, the instant invention will now be described with particular reference to the accompanying drawings.

DETAILED DESCRIPTION OF THE PREFERRED EMBODIMENT

Figure 1:
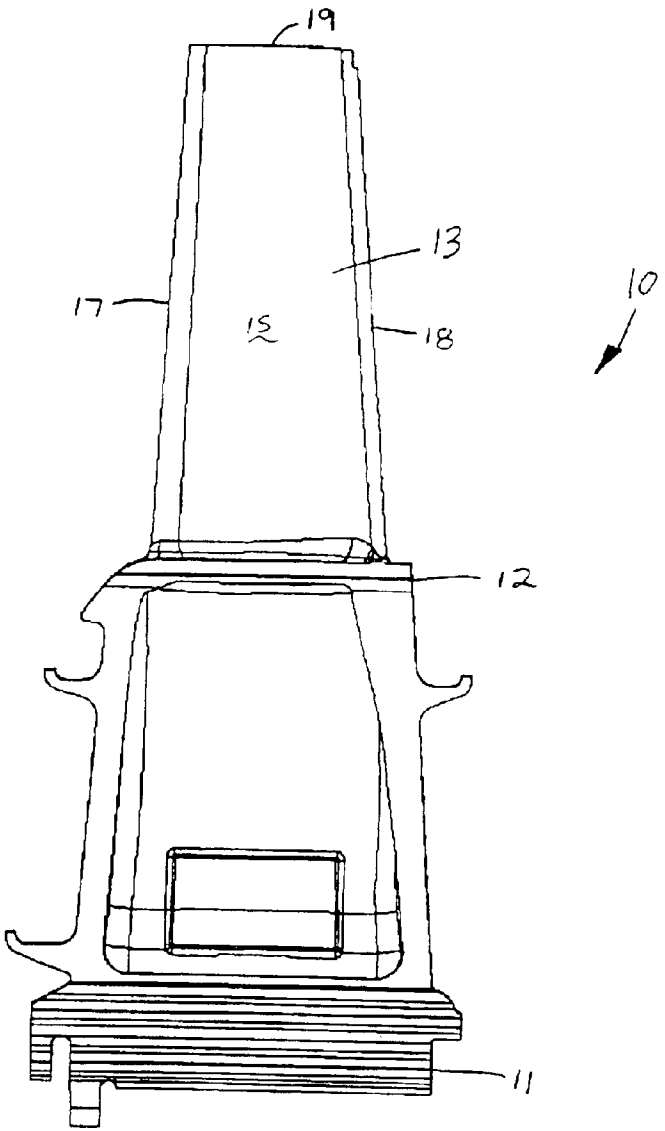
FIG. 1 is a side elevation view of a turbine blade including an airfoil in accordance with the present invention.
Figure 2:
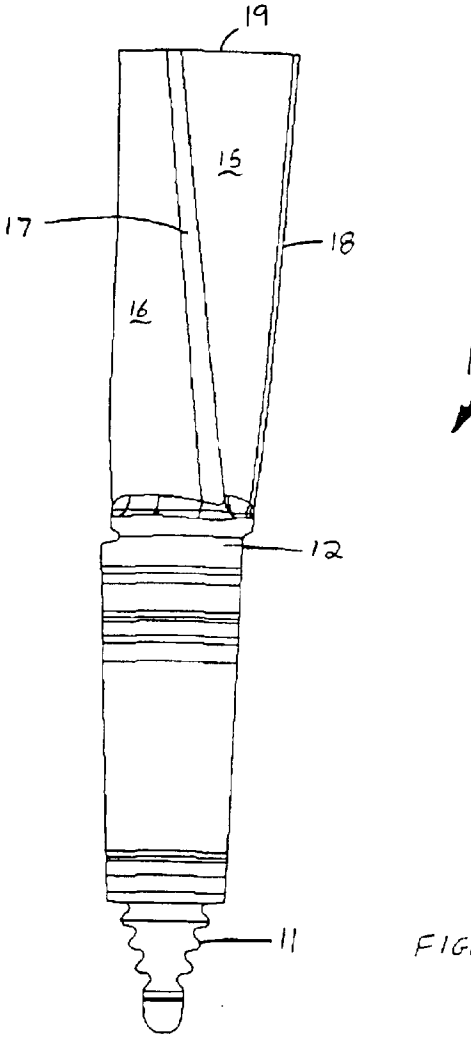
FIG. 2 is an axial view of a turbine blade including an airfoil in accordance with the present invention.
Figure 3:
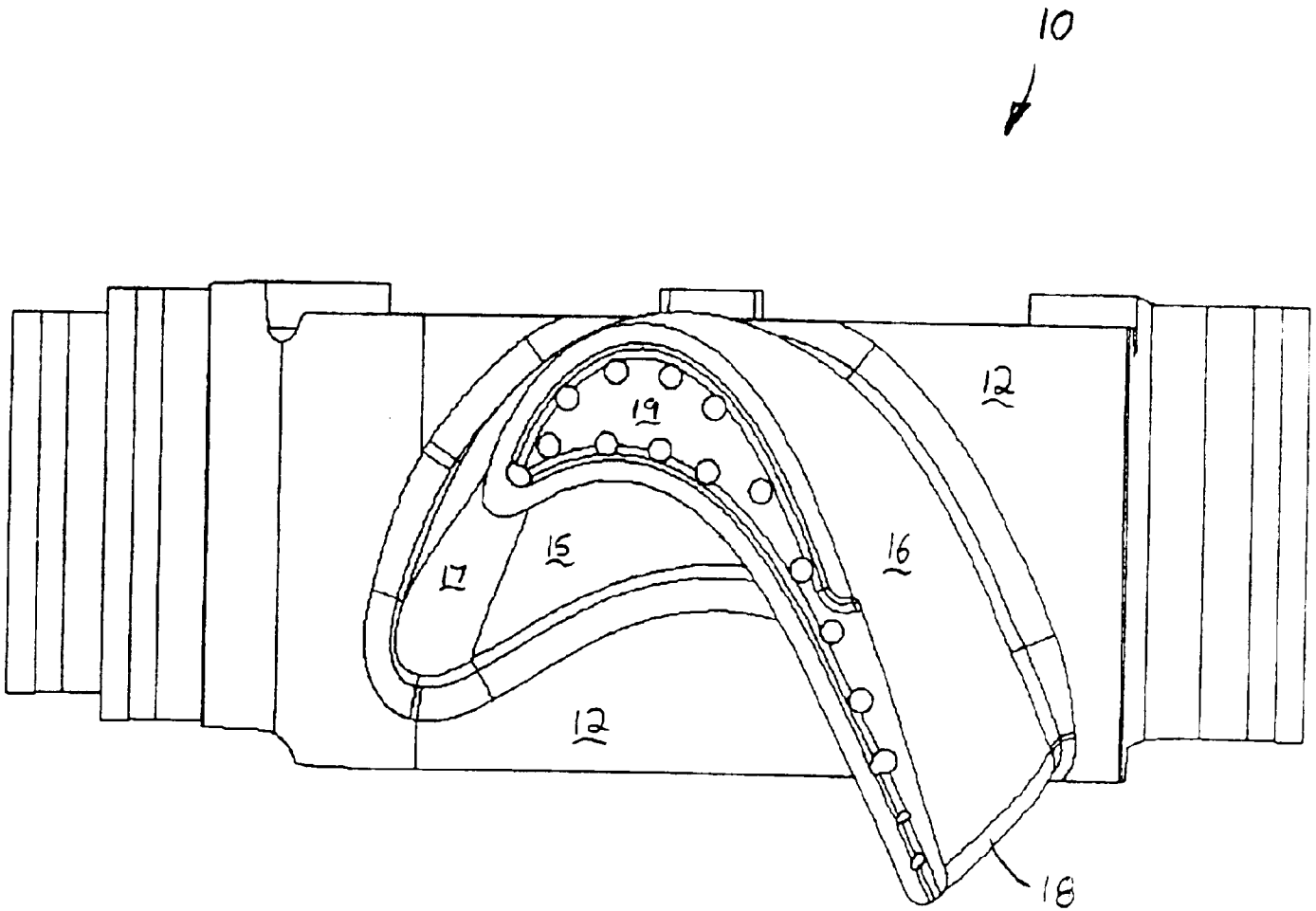
FIG. 3 is a top view of a turbine blade including an airfoil in accordance with the present invention.

Referring to FIGS. 1–3, a turbine blade 10 is shown in accordance with the present invention. Turbine blade 10 includes an attachment 11, a platform 12 extending radially outward from attachment 11, and an airfoil 13 extending radially outward from platform 12. Airfoil 13 has a compound curvature that includes a pressure side 15 and a suction side 16 joined together at leading edge 17 and trailing edge 18. Turbine blade 10 is cast from a nickel-based superalloy to provide superior resistance to the elevated temperatures of the hot combustion gases that drive the turbine.

To combat the elevated temperatures experienced by turbine blade 10, the blade is cooled through a plurality of radially extending holes 20 that extend from attachment 11, through platform 12 and airfoil 13, to blade tip 19. Holes 20 pass a cooling medium, typically air or steam, through blade 10 to cool airfoil 13. In the preferred embodiment, the plurality of radially extending holes 20 comprises sixteen holes.

Figure 4:
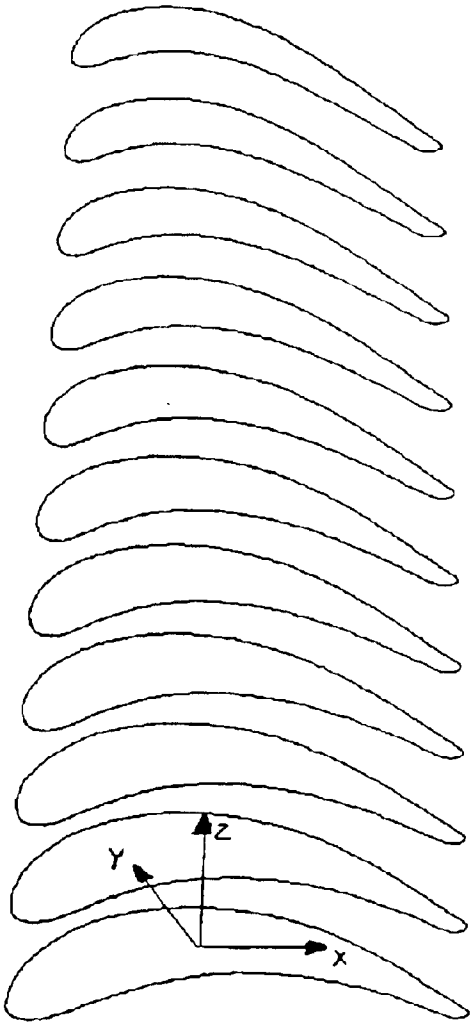
FIG. 4 is a perspective view illustrating the airfoil profile outlined in the Cartesian coordinates of Table 1.

Airfoil 13 has an uncoated profile substantially in accordance with Cartesian coordinate values X, Y, and Z as set forth in Table 1, wherein Z is measured radially from platform 12 and X is generally parallel to the engine centerline. All coordinate values X, Y, and Z are measured in inches. A series of sections are created at each radial distance Z by connecting the X and Y coordinates with smooth arcs. These sections are shown in perspective view in FIG. 4. The surfaces of airfoil 13, including pressure side 15, suction side 16, leading edge 17, and trailing edge 18 can then be created by connecting adjacent sections of X,Y coordinate data. Depending on manufacturing tolerances, the profile of a single section of airfoil 13 can vary, typically ±0.006 inches, with tolerances for the section reaching ±0.030 inches relative to the coordinate system. The airfoil can have manufacturing tolerances of about +/−0.010 inches.

To reduce the impact of oxidation on airfoil 13, a metallic coating is applied to the external surfaces of airfoil 13. The preferred coating is a metallic MCrAlY with a diffused aluminide overlay applied up to 0.010 inches thick.

Airfoil 13 has been designed to reduce overall heat load to the airfoil surfaces, including the leading edge 17, despite having a greater surface area than some airfoils of the prior art. This reduced heat load is accomplished by having a lower overall heat transfer coefficient. The majority of this overall reduction can be found along pressure side 15, and is due to the aerodynamic changes to the airfoil. The heat load has also been reduced to leading edge 17, which has been determined to be the life-limiting region of turbine blade 10. The reduced heat load in both leading edge 17 and the entire airfoil 13 results in lower metal temperatures, predicted to be approximately 10 degrees F. These lower metal temperatures in turn extend the blade life, especially at the life limiting leading edge location.

Figure 5:
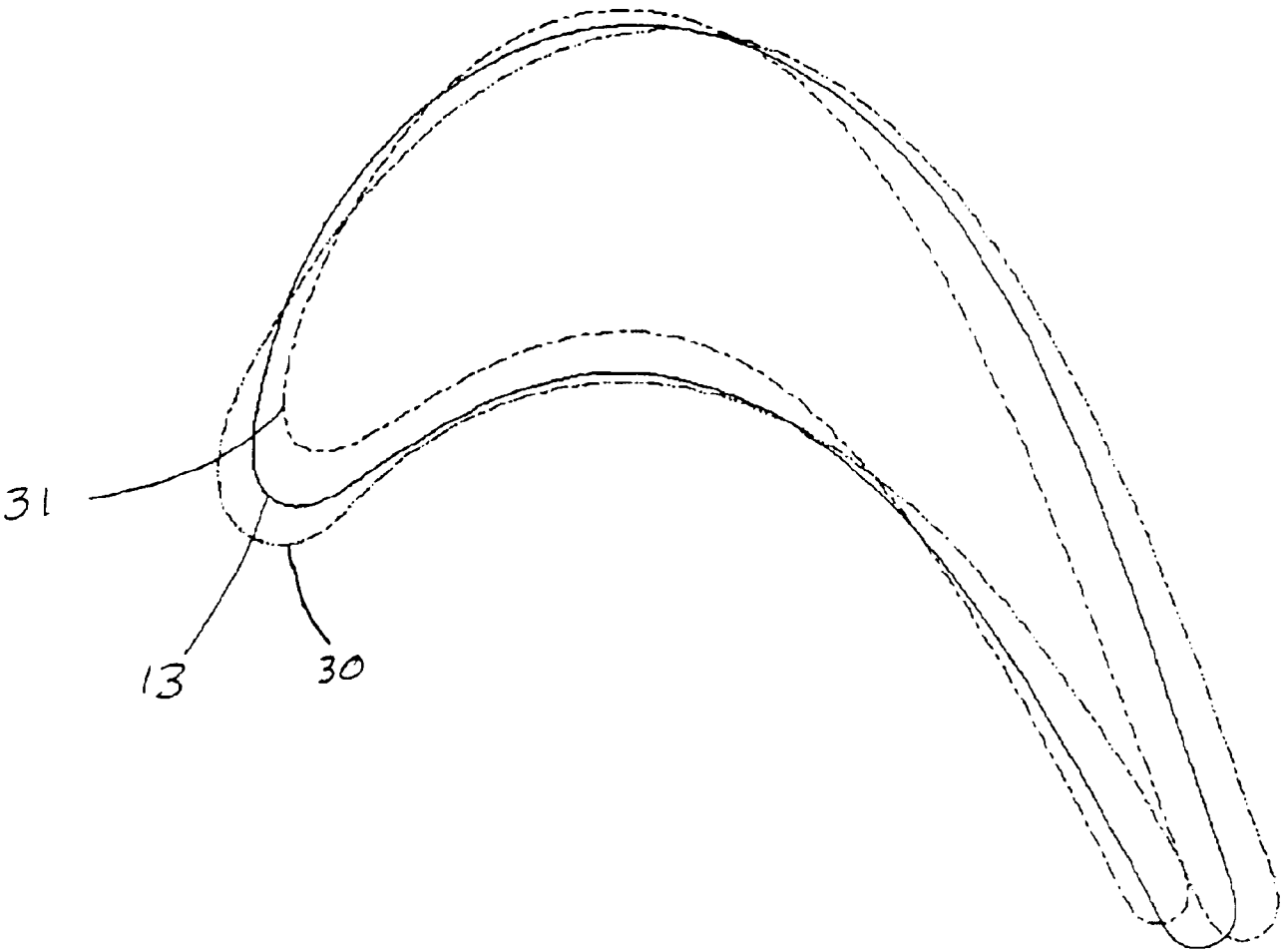
FIG. 5 is a cross section view overlaying an airfoil section of the present invention with airfoil sections of the prior art.

As previously mentioned, the lower heat transfer coefficients and corresponding lower heat load are a result of aerodynamic changes to airfoil 13. Referring now to FIG. 5, a cross section of airfoil 13 disclosed in the present invention is shown overlayed with airfoil cross sections of prior art blades used in the same turbine stage of the same engine. A first blade design 30 is shown in cross section having a generally blunt leading edge region along with a second blade design 31 having a sharper leading edge design. First blade 30 contained twelve radially extending holes while second blade 31 contains sixteen radially extending holes. It can also be seen from FIG. 5 that second blade 31 has a different aerodynamic profile including a shorter chord length, which contributes to a lower heat load by having a smaller surface area. Furthermore, second blade design 31 has increased cooling due to the increase in quantity of cooling holes. However, despite second blade 31 having a lower overall heat load, it has a higher heat load at the leading edge due to the sharper leading edge design restricting the amount of cooling compared to first blade design 30. The present invention expands upon the overall reduced heat load provided by second blade 31 by further enhancing the airfoil aerodynamic profile to reduce the heat transfer coefficient on pressure side 15 while allowing for more cooling medium to be directed to the leading edge region 17, thereby lowering operating temperatures and increasing life to the life limiting location of the turbine blade.

TABLE 1

| X | Y | Z |
|---|---|---|
| 1.0882 | −0.8239 | 0.0000 |
| 1.0094 | −0.7126 | 0.0000 |
| 0.9292 | −0.6147 | 0.0000 |
| 0.8486 | −0.5296 | 0.0000 |
| 0.7683 | −0.4564 | 0.0000 |
| 0.6885 | −0.3942 | 0.0000 |
| 0.6090 | −0.3416 | 0.0000 |
| 0.5296 | −0.2978 | 0.0000 |
| 0.4500 | −0.2618 | 0.0000 |
| 0.3698 | −0.2333 | 0.0000 |
| 0.2891 | −0.2118 | 0.0000 |
| 0.2080 | −0.1973 | 0.0000 |
| 0.1269 | −0.1898 | 0.0000 |
| 0.0454 | −0.1889 | 0.0000 |
| −0.0380 | −0.1950 | 0.0000 |
| −0.1245 | −0.2086 | 0.0000 |
| −0.2123 | −0.2300 | 0.0000 |
| −0.2984 | −0.2583 | 0.0000 |
| −0.3796 | −0.2913 | 0.0000 |
| −0.4521 | −0.3256 | 0.0000 |
| −0.5144 | −0.3581 | 0.0000 |
| −0.5693 | −0.3887 | 0.0000 |
| −0.6204 | −0.4184 | 0.0000 |
| −0.6708 | −0.4483 | 0.0000 |
| −0.7217 | −0.4784 | 0.0000 |
| −0.7729 | −0.5080 | 0.0000 |
| −0.8244 | −0.5364 | 0.0000 |
| −0.8377 | −0.5434 | 0.0000 |
| −0.8509 | −0.5503 | 0.0000 |
| −0.8643 | −0.5569 | 0.0000 |
| −0.8781 | −0.5634 | 0.0000 |
| −0.8925 | −0.5698 | 0.0000 |
| −0.9080 | −0.5757 | 0.0000 |
| −0.9246 | −0.5810 | 0.0000 |
| −0.9427 | −0.5852 | 0.0000 |
| −0.9618 | −0.5876 | 0.0000 |
| −0.9807 | −0.5878 | 0.0000 |
| −0.9983 | −0.5856 | 0.0000 |
| −1.0142 | −0.5813 | 0.0000 |
| −1.0284 | −0.5753 | 0.0000 |
| −1.0410 | −0.5678 | 0.0000 |
| −1.0521 | −0.5588 | 0.0000 |
| −1.0619 | −0.5482 | 0.0000 |
| −1.0699 | −0.5364 | 0.0000 |
| −1.0765 | −0.5235 | 0.0000 |
| −1.0815 | −0.5090 | 0.0000 |
| −1.0850 | −0.4931 | 0.0000 |
| −1.0868 | −0.4766 | 0.0000 |
| −1.0871 | −0.4600 | 0.0000 |
| −1.0860 | −0.4436 | 0.0000 |
| −1.0839 | −0.4273 | 0.0000 |
| −1.0810 | −0.4115 | 0.0000 |
| −1.0777 | −0.3960 | 0.0000 |
| −1.0740 | −0.3810 | 0.0000 |
| −1.0700 | −0.3663 | 0.0000 |
| −1.0658 | −0.3517 | 0.0000 |
| −1.0615 | −0.3371 | 0.0000 |
| −1.0261 | −0.2320 | 0.0000 |
| −0.9902 | −0.1437 | 0.0000 |
| −0.9551 | −0.0687 | 0.0000 |
| −0.9207 | −0.0033 | 0.0000 |
| −0.8866 | 0.0557 | 0.0000 |
| −0.8514 | 0.1111 | 0.0000 |
| −0.8140 | 0.1652 | 0.0000 |
| −0.7742 | 0.2177 | 0.0000 |
| −0.7324 | 0.2680 | 0.0000 |
| −0.6886 | 0.3162 | 0.0000 |
| −0.6424 | 0.3621 | 0.0000 |
| −0.5937 | 0.4057 | 0.0000 |
| −0.5427 | 0.4464 | 0.0000 |
| −0.4898 | 0.4836 | 0.0000 |
| −0.4350 | 0.5172 | 0.0000 |
| −0.3775 | 0.5474 | 0.0000 |
| −0.3164 | 0.5741 | 0.0000 |
| −0.2509 | 0.5967 | 0.0000 |
| −0.1817 | 0.6143 | 0.0000 |
| −0.1106 | 0.6259 | 0.0000 |

TABLE 1-continued

| X | Y | Z |
|---|---|---|
| −0.0396 | 0.6311 | 0.0000 |
| 0.0309 | 0.6299 | 0.0000 |
| 0.1009 | 0.6224 | 0.0000 |
| 0.1703 | 0.6089 | 0.0000 |
| 0.2396 | 0.5893 | 0.0000 |
| 0.3084 | 0.5633 | 0.0000 |
| 0.3760 | 0.5309 | 0.0000 |
| 0.4424 | 0.4919 | 0.0000 |
| 0.5083 | 0.4455 | 0.0000 |
| 0.5738 | 0.3909 | 0.0000 |
| 0.6394 | 0.3267 | 0.0000 |
| 0.7054 | 0.2514 | 0.0000 |
| 0.7717 | 0.1629 | 0.0000 |
| 0.8391 | 0.0584 | 0.0000 |
| 0.9082 | −0.0648 | 0.0000 |
| 0.9791 | −0.2074 | 0.0000 |
| 1.0529 | −0.3696 | 0.0000 |
| 1.1314 | −0.5522 | 0.0000 |
| 1.2158 | −0.7573 | 0.0000 |
| 1.2202 | −0.7683 | 0.0000 |
| 1.2241 | −0.7794 | 0.0000 |
| 1.2271 | −0.7904 | 0.0000 |
| 1.2288 | −0.8011 | 0.0000 |
| 1.2291 | −0.8112 | 0.0000 |
| 1.2281 | −0.8210 | 0.0000 |
| 1.2255 | −0.8306 | 0.0000 |
| 1.2213 | −0.8399 | 0.0000 |
| 1.2155 | −0.8486 | 0.0000 |
| 1.2084 | −0.8565 | 0.0000 |
| 1.2002 | −0.8631 | 0.0000 |
| 1.1912 | −0.8685 | 0.0000 |
| 1.1817 | −0.8726 | 0.0000 |
| 1.1716 | −0.8753 | 0.0000 |
| 1.1612 | −0.8764 | 0.0000 |
| 1.1509 | −0.8759 | 0.0000 |
| 1.1410 | −0.8738 | 0.0000 |
| 1.1318 | −0.8701 | 0.0000 |
| 1.1234 | −0.8651 | 0.0000 |
| 1.1155 | −0.8589 | 0.0000 |
| 1.1081 | −0.8514 | 0.0000 |
| 1.1011 | −0.8428 | 0.0000 |
| 1.0945 | −0.8335 | 0.0000 |
| 1.0882 | −0.8239 | 0.0000 |
| 1.0697 | −0.8573 | 0.2437 |
| 0.9808 | −0.7287 | 0.2437 |
| 0.8932 | −0.6187 | 0.2437 |
| 0.8078 | −0.5254 | 0.2437 |
| 0.7246 | −0.4468 | 0.2437 |
| 0.6434 | −0.3808 | 0.2437 |
| 0.5634 | −0.3254 | 0.2437 |
| 0.4843 | −0.2794 | 0.2437 |
| 0.4055 | −0.2416 | 0.2437 |
| 0.3271 | −0.2116 | 0.2437 |
| 0.2489 | −0.1888 | 0.2437 |
| 0.1712 | −0.1730 | 0.2437 |
| 0.0940 | −0.1641 | 0.2437 |
| 0.0165 | −0.1616 | 0.2437 |
| −0.0618 | −0.1657 | 0.2437 |
| −0.1414 | −0.1767 | 0.2437 |
| −0.2216 | −0.1948 | 0.2437 |
| −0.3016 | −0.2198 | 0.2437 |
| −0.3783 | −0.2501 | 0.2437 |
| −0.4479 | −0.2828 | 0.2437 |
| −0.5088 | −0.3148 | 0.2437 |
| −0.5633 | −0.3458 | 0.2437 |
| −0.6141 | −0.3763 | 0.2437 |
| −0.6638 | −0.4069 | 0.2437 |
| −0.7134 | −0.4377 | 0.2437 |
| −0.7632 | −0.4682 | 0.2437 |
| −0.8135 | −0.4978 | 0.2437 |
| −0.8263 | −0.5052 | 0.2437 |
| −0.8390 | −0.5123 | 0.2437 |
| −0.8519 | −0.5193 | 0.2437 |
| −0.8653 | −0.5261 | 0.2437 |
| −0.8795 | −0.5329 | 0.2437 |
| −0.8946 | −0.5393 | 0.2437 |
| −0.9104 | −0.5449 | 0.2437 |

TABLE 1-continued

| X | Y | Z |
|---|---|---|
| −0.9268 | −0.5495 | 0.2437 |
| −0.9437 | −0.5526 | 0.2437 |
| −0.9605 | −0.5539 | 0.2437 |
| −0.9765 | −0.5534 | 0.2437 |
| −0.9915 | −0.5511 | 0.2437 |
| −1.0057 | −0.5472 | 0.2437 |
| −1.0191 | −0.5416 | 0.2437 |
| −1.0312 | −0.5343 | 0.2437 |
| −1.0416 | −0.5257 | 0.2437 |
| −1.0504 | −0.5160 | 0.2437 |
| −1.0576 | −0.5051 | 0.2437 |
| −1.0636 | −0.4928 | 0.2437 |
| −1.0682 | −0.4788 | 0.2437 |
| −1.0714 | −0.4632 | 0.2437 |
| −1.0730 | −0.4471 | 0.2437 |
| −1.0733 | −0.4312 | 0.2437 |
| −1.0724 | −0.4153 | 0.2437 |
| −1.0707 | −0.3996 | 0.2437 |
| −1.0684 | −0.3842 | 0.2437 |
| −1.0656 | −0.3691 | 0.2437 |
| −1.0625 | −0.3543 | 0.2437 |
| −1.0592 | −0.3397 | 0.2437 |
| −1.0556 | −0.3252 | 0.2437 |
| −1.0519 | −0.3106 | 0.2437 |
| −1.0187 | −0.2015 | 0.2437 |
| −0.9838 | −0.1106 | 0.2437 |
| −0.9488 | −0.0340 | 0.2437 |
| −0.9142 | 0.0325 | 0.2437 |
| −0.8794 | 0.0922 | 0.2437 |
| −0.8433 | 0.1485 | 0.2437 |
| −0.8046 | 0.2035 | 0.2437 |
| −0.7635 | 0.2565 | 0.2437 |
| −0.7203 | 0.3073 | 0.2437 |
| −0.6751 | 0.3559 | 0.2437 |
| −0.6272 | 0.4022 | 0.2437 |
| −0.5768 | 0.4459 | 0.2437 |
| −0.5241 | 0.4864 | 0.2437 |
| −0.4695 | 0.5232 | 0.2437 |
| −0.4130 | 0.5559 | 0.2437 |
| −0.3547 | 0.5844 | 0.2437 |
| −0.2948 | 0.6082 | 0.2437 |
| −0.2333 | 0.6271 | 0.2437 |
| −0.1706 | 0.6409 | 0.2437 |
| −0.1078 | 0.6492 | 0.2437 |
| −0.0458 | 0.6521 | 0.2437 |
| 0.0155 | 0.6498 | 0.2437 |
| 0.0769 | 0.6423 | 0.2437 |
| 0.1374 | 0.6299 | 0.2437 |
| 0.1944 | 0.6136 | 0.2437 |
| 0.2476 | 0.5944 | 0.2437 |
| 0.2988 | 0.5720 | 0.2437 |
| 0.3496 | 0.5456 | 0.2437 |
| 0.4014 | 0.5143 | 0.2437 |
| 0.4532 | 0.4780 | 0.2437 |
| 0.5029 | 0.4384 | 0.2437 |
| 0.5495 | 0.3966 | 0.2437 |
| 0.5933 | 0.3530 | 0.2437 |
| 0.6363 | 0.3058 | 0.2437 |
| 0.6806 | 0.2521 | 0.2437 |
| 0.7277 | 0.1890 | 0.2437 |
| 0.7778 | 0.1143 | 0.2437 |
| 0.8301 | 0.0276 | 0.2437 |
| 0.8840 | −0.0715 | 0.2437 |
| 0.9398 | −0.1842 | 0.2437 |
| 0.9983 | −0.3115 | 0.2437 |
| 1.0603 | −0.4544 | 0.2437 |
| 1.1264 | −0.6140 | 0.2437 |
| 1.1974 | −0.7911 | 0.2437 |
| 1.2017 | −0.8022 | 0.2437 |
| 1.2055 | −0.8133 | 0.2437 |
| 1.2084 | −0.8243 | 0.2437 |
| 1.2100 | −0.8350 | 0.2437 |
| 1.2103 | −0.8452 | 0.2437 |
| 1.2091 | −0.8550 | 0.2437 |
| 1.2065 | −0.8646 | 0.2437 |
| 1.2022 | −0.8738 | 0.2437 |
| 1.1964 | −0.8825 | 0.2437 |

TABLE 1-continued

| X | Y | Z |
|---|---|---|
| 1.1893 | −0.8903 | 0.2437 |
| 1.1811 | −0.8969 | 0.2437 |
| 1.1721 | −0.9023 | 0.2437 |
| 1.1626 | −0.9063 | 0.2437 |
| 1.1526 | −0.9089 | 0.2437 |
| 1.1422 | −0.9100 | 0.2437 |
| 1.1319 | −0.9095 | 0.2437 |
| 1.1221 | −0.9073 | 0.2437 |
| 1.1130 | −0.9036 | 0.2437 |
| 1.1046 | −0.8986 | 0.2437 |
| 1.0968 | −0.8923 | 0.2437 |
| 1.0894 | −0.8848 | 0.2437 |
| 1.0825 | −0.8762 | 0.2437 |
| 1.0760 | −0.8669 | 0.2437 |
| 1.0697 | −0.8573 | 0.2437 |
| 1.0511 | −0.8880 | 0.4875 |
| 0.9528 | −0.7426 | 0.4875 |
| 0.8590 | −0.6212 | 0.4875 |
| 0.7700 | −0.5205 | 0.4875 |
| 0.6852 | −0.4371 | 0.4875 |
| 0.6034 | −0.3679 | 0.4875 |
| 0.5240 | −0.3102 | 0.4875 |
| 0.4459 | −0.2624 | 0.4875 |
| 0.3689 | −0.2232 | 0.4875 |
| 0.2929 | −0.1920 | 0.4875 |
| 0.2177 | −0.1681 | 0.4875 |
| 0.1435 | −0.1513 | 0.4875 |
| 0.0697 | −0.1410 | 0.4875 |
| −0.0039 | −0.1370 | 0.4875 |
| −0.0774 | −0.1392 | 0.4875 |
| −0.1516 | −0.1480 | 0.4875 |
| −0.2267 | −0.1634 | 0.4875 |
| 0.3025 | −0.1857 | 0.4875 |
| −0.3760 | −0.2137 | 0.4875 |
| −0.4435 | −0.2448 | 0.4875 |
| −0.5033 | −0.2762 | 0.4875 |
| −0.5574 | −0.3072 | 0.4875 |
| −0.6078 | −0.3381 | 0.4875 |
| −0.6568 | −0.3691 | 0.4875 |
| −0.7052 | −0.4002 | 0.4875 |
| −0.7536 | −0.4311 | 0.4875 |
| −0.8027 | −0.4616 | 0.4875 |
| −0.8153 | −0.4693 | 0.4875 |
| −0.8277 | −0.4767 | 0.4875 |
| −0.8404 | −0.4840 | 0.4875 |
| −0.8535 | −0.4912 | 0.4875 |
| −0.8675 | −0.4983 | 0.4875 |
| −0.8824 | −0.5051 | 0.4875 |
| −0.8979 | −0.5111 | 0.4875 |
| −0.9141 | −0.5161 | 0.4875 |
| −0.9307 | −0.5196 | 0.4875 |
| −0.9472 | −0.5214 | 0.4875 |
| −0.9631 | −0.5214 | 0.4875 |
| −0.9780 | −0.5197 | 0.4875 |
| −0.9921 | −0.5164 | 0.4875 |
| −1.0055 | −0.5112 | 0.4875 |
| −1.0175 | −0.5045 | 0.4875 |
| −1.0276 | −0.4966 | 0.4875 |
| −1.0362 | −0.4876 | 0.4875 |
| −1.0433 | −0.4775 | 0.4875 |
| −1.0492 | −0.4658 | 0.4875 |
| −1.0538 | −0.4522 | 0.4875 |
| −1.0571 | −0.4369 | 0.4875 |
| −1.0589 | −0.4210 | 0.4875 |
| −1.0593 | −0.4052 | 0.4875 |
| −1.0588 | −0.3895 | 0.4875 |
| −1.0574 | −0.3739 | 0.4875 |
| −1.0555 | −0.3585 | 0.4875 |
| −1.0531 | −0.3434 | 0.4875 |
| −1.0505 | −0.3286 | 0.4875 |
| −1.0477 | −0.3139 | 0.4875 |
| −1.0446 | −0.2993 | 0.4875 |
| −1.0412 | −0.2847 | 0.4875 |
| −1.0241 | −0.2189 | 0.4875 |
| −1.0039 | −0.1540 | 0.4875 |
| −0.9802 | −0.0905 | 0.4875 |
| −0.9535 | −0.0284 | 0.4875 |

TABLE 1-continued

| X | Y | Z |
|---|---|---|
| −0.9240 | 0.0322 | 0.4875 |
| −0.8917 | 0.0910 | 0.4875 |
| −0.8567 | 0.1483 | 0.4875 |
| 0.8193 | 0.2037 | 0.4875 |
| −0.7794 | 0.2573 | 0.4875 |
| −0.7373 | 0.3087 | 0.4875 |
| −0.6931 | 0.3579 | 0.4875 |
| −0.6466 | 0.4049 | 0.4875 |
| −0.5974 | 0.4494 | 0.4875 |
| −0.5457 | 0.4910 | 0.4875 |
| −0.4922 | 0.5290 | 0.4875 |
| −0.4373 | 0.5626 | 0.4875 |
| −0.3810 | 0.5920 | 0.4875 |
| −0.3233 | 0.6169 | 0.4875 |
| −0.2639 | 0.6370 | 0.4875 |
| −0.2029 | 0.6522 | 0.4875 |
| −0.1411 | 0.6620 | 0.4875 |
| −0.0795 | 0.6663 | 0.4875 |
| −0.0190 | 0.6652 | 0.4875 |
| 0.0408 | 0.6589 | 0.4875 |
| 0.1003 | 0.6475 | 0.4875 |
| 0.1583 | 0.6313 | 0.4875 |
| 0.2127 | 0.6118 | 0.4875 |
| 0.2640 | 0.5893 | 0.4875 |
| 0.3138 | 0.5635 | 0.4875 |
| 0.3633 | 0.5336 | 0.4875 |
| 0.4134 | 0.4987 | 0.4875 |
| 0.4629 | 0.4592 | 0.4875 |
| 0.5099 | 0.4171 | 0.4875 |
| 0.5540 | 0.3732 | 0.4875 |
| 0.5956 | 0.3276 | 0.4875 |
| 0.6368 | 0.2783 | 0.4875 |
| 0.6794 | 0.2224 | 0.4875 |
| 0.7248 | 0.1570 | 0.4875 |
| 0.7730 | 0.0805 | 0.4875 |
| 0.8233 | −0.0074 | 0.4875 |
| 0.8752 | −0.1071 | 0.4875 |
| 0.9293 | −0.2199 | 0.4875 |
| 0.9861 | −0.3470 | 0.4875 |
| 1.0463 | −0.4894 | 0.4875 |
| 1.1103 | −0.6478 | 0.4875 |
| 1.1788 | −0.8225 | 0.4875 |
| 1.1831 | −0.8336 | 0.4875 |
| 1.1868 | −0.8447 | 0.4875 |
| 1.1896 | −0.8557 | 0.4875 |
| 1.1912 | −0.8664 | 0.4875 |
| 1.1914 | −0.8766 | 0.4875 |
| 1.1902 | −0.8864 | 0.4875 |
| 1.1874 | −0.8960 | 0.4875 |
| 1.1831 | −0.9052 | 0.4875 |
| 1.1773 | −0.9139 | 0.4875 |
| 1.1701 | −0.9216 | 0.4875 |
| 1.1619 | −0.9282 | 0.4875 |
| 1.1530 | −0.9335 | 0.4875 |
| 1.1434 | −0.9374 | 0.4875 |
| 1.1334 | −0.9400 | 0.4875 |
| 1.1231 | −0.9410 | 0.4875 |
| 1.1128 | −0.9404 | 0.4875 |
| 1.1030 | −0.9382 | 0.4875 |
| 1.0939 | −0.9345 | 0.4875 |
| 1.0856 | −0.9294 | 0.4875 |
| 1.0778 | −0.9231 | 0.4875 |
| 1.0705 | −0.9155 | 0.4875 |
| 1.0637 | −0.9069 | 0.4875 |
| 1.0573 | −0.8976 | 0.4875 |
| 1.0511 | −0.8880 | 0.4875 |
| 1.0323 | −0.9162 | 0.7312 |
| 0.9314 | −0.7630 | 0.7312 |
| 0.8354 | −0.6337 | 0.7312 |
| 0.7445 | −0.5258 | 0.7312 |
| 0.6583 | −0.4366 | 0.7312 |
| 0.5762 | −0.3629 | 0.7312 |
| 0.4971 | −0.3020 | 0.7312 |
| 0.4201 | −0.2516 | 0.7312 |
| 0.3449 | −0.2105 | 0.7312 |
| 0.2711 | −0.1775 | 0.7312 |
| 0.1984 | −0.1521 | 0.7312 |

TABLE 1-continued

| X | Y | Z |
|---|---|---|
| 0.1267 | −0.1336 | 0.7312 |
| 0.0557 | −0.1215 | 0.7312 |
| −0.0145 | −0.1157 | 0.7312 |
| −0.0844 | −0.1160 | 0.7312 |
| −0.1547 | −0.1224 | 0.7312 |
| −0.2264 | −0.1352 | 0.7312 |
| −0.2995 | −0.1550 | 0.7312 |
| −0.3709 | −0.1808 | 0.7312 |
| −0.4371 | −0.2102 | 0.7312 |
| −0.4963 | −0.2409 | 0.7312 |
| −0.5503 | −0.2718 | 0.7312 |
| −0.6007 | −0.3028 | 0.7312 |
| −0.6490 | −0.3339 | 0.7312 |
| −0.6965 | −0.3652 | 0.7312 |
| −0.7440 | −0.3964 | 0.7312 |
| 0.7921 | −0.4275 | 0.7312 |
| −0.8045 | −0.4354 | 0.7312 |
| −0.8167 | −0.4430 | 0.7312 |
| −0.8291 | −0.4505 | 0.7312 |
| −0.8420 | −0.4580 | 0.7312 |
| −0.8558 | −0.4654 | 0.7312 |
| −0.8703 | −0.4725 | 0.7312 |
| −0.8856 | −0.4789 | 0.7312 |
| −0.9015 | −0.4842 | 0.7312 |
| −0.9178 | −0.4882 | 0.7312 |
| −0.9341 | −0.4904 | 0.7312 |
| −0.9497 | −0.4908 | 0.7312 |
| −0.9644 | −0.4895 | 0.7312 |
| −0.9784 | −0.4866 | 0.7312 |
| −0.9916 | −0.4819 | 0.7312 |
| −1.0034 | −0.4757 | 0.7312 |
| −1.0134 | −0.4682 | 0.7312 |
| −1.0218 | −0.4597 | 0.7312 |
| −1.0288 | −0.4501 | 0.7312 |
| −1.0346 | −0.4388 | 0.7312 |
| −1.0393 | −0.4256 | 0.7312 |
| −1.0426 | −0.4106 | 0.7312 |
| −1.0445 | −0.3950 | 0.7312 |
| −1.0451 | −0.3794 | 0.7312 |
| −1.0448 | −0.3639 | 0.7312 |
| −1.0437 | −0.3484 | 0.7312 |
| −1.0421 | −0.3331 | 0.7312 |
| −1.0401 | −0.3180 | 0.7312 |
| −1.0379 | −0.3032 | 0.7312 |
| −1.0354 | −0.2886 | 0.7312 |
| −1.0327 | −0.2740 | 0.7312 |
| −1.0297 | −0.2594 | 0.1312 |
| −1.0140 | −0.1936 | 0.7312 |
| −0.9949 | −0.1286 | 0.7312 |
| −0.9722 | −0.0650 | 0.7312 |
| −0.9461 | −0.0029 | 0.7312 |
| −0.9170 | 0.0577 | 0.7312 |
| −0.8850 | 0.1165 | 0.7312 |
| −0.8501 | 0.1736 | 0.7312 |
| −0.8127 | 0.2289 | 0.7312 |
| −0.7726 | 0.2822 | 0.7312 |
| −0.7303 | 0.3331 | 0.7312 |
| −0.6857 | 0.3819 | 0.7312 |
| −0.6388 | 0.4284 | 0.7312 |
| −0.5892 | 0.4721 | 0.7312 |
| −0.5372 | 0.5128 | 0.7312 |
| −0.4827 | 0.5501 | 0.7312 |
| −0.4255 | 0.5836 | 0.7312 |
| −0.3651 | 0.6132 | 0.7312 |
| −0.3029 | 0.6374 | 0.7312 |
| −0.2422 | 0.6551 | 0.7312 |
| −0.1830 | 0.6670 | 0.7312 |
| −0.1237 | 0.6737 | 0.7312 |
| −0.0639 | 0.6751 | 0.7312 |
| −0.0044 | 0.6712 | 0.7312 |
| 0.0547 | 0.6621 | 0.7312 |
| 0.1132 | 0.6477 | 0.7312 |
| 0.1697 | 0.6288 | 0.7312 |
| 0.2226 | 0.6067 | 0.7312 |
| 0.2727 | 0.5816 | 0.7312 |
| 0.3213 | 0.5532 | 0.7312 |
| 0.3697 | 0.5207 | 0.7312 |

TABLE 1-continued

| X | Y | Z |
|---|---|---|
| 0.4183 | 0.4832 | 0.7312 |
| 0.4661 | 0.4414 | 0.7312 |
| 0.5114 | 0.3972 | 0.7312 |
| 0.5537 | 0.3516 | 0.7312 |
| 0.5937 | 0.3044 | 0.7312 |
| 0.6335 | 0.2534 | 0.7312 |
| 0.6747 | 0.1959 | 0.7312 |
| 0.7186 | 0.1289 | 0.7312 |
| 0.7652 | 0.0511 | 0.7312 |
| 0.8138 | −0.0376 | 0.7312 |
| 0.8642 | −0.1379 | 0.7312 |
| 0.9168 | −0.2509 | 0.7312 |
| 0.9722 | −0.3779 | 0.7312 |
| 1.0309 | −0.5201 | 0.7312 |
| 1.0934 | −0.6780 | 0.7312 |
| 1.1602 | −0.8516 | 0.7312 |
| 1.1643 | −0.8627 | 0.7312 |
| 1.1680 | −0.8738 | 0.7312 |
| 1.1708 | −0.8849 | 0.7312 |
| 1.1722 | −0.8955 | 0.7312 |
| 1.1724 | −0.9057 | 0.7312 |
| 1.1711 | −0.9155 | 0.7312 |
| 1.1683 | −0.9250 | 0.7312 |
| 1.1640 | −0.9343 | 0.7312 |
| 1.1581 | −0.9429 | 0.7312 |
| 1.1509 | −0.9506 | 0.7312 |
| 1.1427 | −0.9571 | 0.7312 |
| 1.1337 | −0.9623 | 0.7312 |
| 1.1241 | −0.9662 | 0.7312 |
| 1.1141 | −0.9687 | 0.7312 |
| 1.1038 | −0.9697 | 0.7312 |
| 1.0936 | −0.9690 | 0.7312 |
| 1.0838 | −0.9667 | 0.7312 |
| 1.0748 | −0.9629 | 0.7312 |
| 1.0665 | −0.9578 | 0.7312 |
| 1.0587 | −0.9515 | 0.7312 |
| 1.0515 | −0.9439 | 0.7312 |
| 1.0448 | −0.9352 | 0.7312 |
| 1.0384 | −0.9259 | 0.7312 |
| 1.0323 | −0.9162 | 0.7312 |
| 1.0133 | −0.9423 | 0.9750 |
| 0.9108 | −0.7828 | 0.9750 |
| 0.8137 | −0.6470 | 0.9750 |
| 0.7216 | −0.5326 | 0.9750 |
| 0.6345 | −0.4377 | 0.9750 |
| 0.5523 | −0.3600 | 0.9750 |
| 0.4739 | −0.2961 | 0.9750 |
| 0.3983 | −0.2435 | 0.9750 |
| 0.3250 | −0.2006 | 0.9750 |
| 0.2532 | −0.1661 | 0.9750 |
| 0.1828 | −0.1391 | 0.9750 |
| 0.1134 | −0.1191 | 0.9750 |
| 0.0449 | −0.1054 | 0.9750 |
| −0.0224 | −0.0980 | 0.9750 |
| −0.0891 | −0.0963 | 0.9750 |
| −0.1564 | −0.1006 | 0.9750 |
| −0.2255 | −0.1111 | 0.9750 |
| −0.2964 | −0.1285 | 0.9750 |
| −0.3661 | −0.1521 | 0.9750 |
| −0.4310 | −0.1798 | 0.9750 |
| −0.4897 | −0.2094 | 0.9750 |
| −0.5434 | −0.2399 | 0.9750 |
| −0.5935 | −0.2707 | 0.9750 |
| −0.6414 | −0.3016 | 0.9750 |
| −0.6880 | −0.3328 | 0.9750 |
| −0.7345 | −0.3639 | 0.9750 |
| −0.7817 | −0.3953 | 0.9750 |
| −0.7939 | −0.4033 | 0.9750 |
| −0.8058 | −0.4110 | 0.9750 |
| −0.8180 | −0.4187 | 0.9750 |
| −0.8307 | −0.4264 | 0.9750 |
| −0.8442 | −0.4340 | 0.9750 |
| −0.8585 | −0.4413 | 0.9750 |
| −0.8734 | −0.4480 | 0.9750 |
| −0.8891 | −0.4537 | 0.9750 |
| −0.9051 | −0.4580 | 0.9750 |
| −0.9210 | −0.4605 | 0.9750 |

TABLE 1-continued

| X | Y | Z |
|---|---|---|
| −0.9363 | −0.4613 | 0.9750 |
| −0.9507 | −0.4604 | 0.9750 |
| −0.9644 | −0.4578 | 0.9750 |
| −0.9774 | −0.4534 | 0.9750 |
| −0.9890 | −0.4475 | 0.9750 |
| −0.9989 | −0.4404 | 0.9750 |
| −1.0072 | −0.4322 | 0.9750 |
| −1.0141 | −0.4228 | 0.9750 |
| −1.0199 | −0.4119 | 0.9750 |
| −1.0246 | −0.3990 | 0.9750 |
| −1.0280 | −0.3843 | 0.9750 |
| −1.0300 | −0.3690 | 0.9750 |
| −1.0307 | −0.3536 | 0.9750 |
| −1.0305 | −0.3383 | 0.9750 |
| −1.0296 | −0.3230 | 0.9750 |
| −1.0283 | −0.3078 | 0.9750 |
| −1.0266 | 0.2929 | 0.9750 |
| −1.0246 | −0.2782 | 0.9750 |
| −1.0224 | −0.2636 | 0.9750 |
| −1.0200 | −0.2491 | 0.9750 |
| −1.0172 | −0.2346 | 0.9750 |
| −1.0026 | −0.1688 | 0.9750 |
| −0.9844 | −0.1039 | 0.9750 |
| −0.9624 | 0.0403 | 0.9750 |
| −0.9369 | 0.0218 | 0.9750 |
| −0.9081 | 0.0822 | 0.9750 |
| −0.8763 | 0.1409 | 0.9750 |
| −0.8415 | 0.1978 | 0.9750 |
| −0.8039 | 0.2528 | 0.9750 |
| −0.7636 | 0.3056 | 0.9750 |
| −0.7209 | 0.3561 | 0.9750 |
| −0.6759 | −0.4043 | 0.9750 |
| −0.6285 | 0.4499 | 0.9750 |
| −0.5782 | 0.4927 | 0.9750 |
| −0.5255 | 0.5323 | 0.9750 |
| −0.4705 | 0.5680 | 0.9750 |
| −0.4132 | 0.5996 | 0.9750 |
| −0.3531 | 0.6270 | 0.9750 |
| −0.2911 | 0.6490 | 0.9750 |
| −0.2307 | 0.6645 | 0.9750 |
| −0.1718 | 0.6742 | 0.9750 |
| −0.1130 | 0.6787 | 0.9750 |
| −0.0537 | 0.6779 | 0.9750 |
| 0.0054 | 0.6717 | 0.9750 |
| 0.0640 | 0.6602 | 0.9750 |
| 0.1217 | 0.6434 | 0.9750 |
| 0.1772 | 0.6222 | 0.9750 |
| 0.2291 | 0.5979 | 0.9750 |
| 0.2782 | 0.5707 | 0.9750 |
| 0.3258 | 0.5403 | 0.9750 |
| 0.3729 | 0.5057 | 0.9750 |
| 0.4202 | 0.4662 | 0.9750 |
| 0.4666 | 0.4227 | 0.9750 |
| 0.5103 | 0.3769 | 0.9750 |
| 0.5513 | 0.3299 | 0.9750 |
| 0.5900 | 0.2814 | 0.9750 |
| 0.6285 | 0.2292 | 0.9750 |
| 0.6684 | 0.1705 | 0.9750 |
| 0.7109 | 0.1025 | 0.9750 |
| 0.7561 | 0.0238 | 0.9750 |
| 0.8032 | −0.0655 | 0.9750 |
| 0.8522 | −0.1661 | 0.9750 |
| 0.9033 | −0.2792 | 0.9750 |
| 0.9573 | −0.4061 | 0.9750 |
| 1.0147 | −0.5478 | 0.9750 |
| 1.0758 | −0.7052 | 0.9750 |
| 1.1415 | −0.8786 | 0.9750 |
| 1.1455 | −0.8897 | 0.9750 |
| 1.1491 | −0.9009 | 0.9750 |
| 1.1518 | −0.9119 | 0.9750 |
| 1.1533 | −0.9226 | 0.9750 |
| 1.1533 | −0.9327 | 0.9750 |
| 1.1520 | −0.9425 | 0.9750 |
| 1.1492 | −0.9520 | 0.9750 |
| 1.1448 | −0.9612 | 0.9750 |
| 1.1389 | −0.9698 | 0.9750 |
| 1.1316 | −0.9774 | 0.9750 |

TABLE 1-continued

| X | Y | Z |
|---|---|---|
| 1.1233 | −0.9839 | 0.9750 |
| 1.1143 | −0.9890 | 0.9750 |
| 1.1048 | −0.9929 | 0.9750 |
| 1.0948 | −0.9953 | 0.9750 |
| 1.0844 | −0.9962 | 0.9750 |
| 1.0742 | −0.9955 | 0.9750 |
| 1.0645 | −0.9931 | 0.9750 |
| 1.0554 | −0.9893 | 0.9750 |
| 1.0472 | −0.9841 | 0.9750 |
| 1.0395 | −0.9777 | 0.9750 |
| 1.0323 | −0.9701 | 0.9750 |
| 1.0256 | −0.9614 | 0.9750 |
| 1.0194 | −0.9520 | 0.9750 |
| 1.0133 | 0.9423 | 0.9750 |
| 0.9942 | −0.9665 | 1.2188 |
| 0.8922 | −0.8040 | 1.2188 |
| 0.7959 | −0.6643 | 1.2188 |
| 0.7047 | −0.5455 | 1.2188 |
| 0.6183 | −0.4462 | 1.2188 |
| 0.5364 | −0.3641 | 1.2188 |
| 0.4585 | −0.2965 | 1.2188 |
| 0.3839 | −0.2411 | 1.2188 |
| 0.3119 | −0.1958 | 1.2188 |
| 0.2418 | −0.1592 | 1.2188 |
| 0.1732 | −0.1304 | 1.2188 |
| 0.1055 | −0.1084 | 1.2188 |
| 0.0391 | −0.0929 | 1.2188 |
| −0.0259 | −0.0836 | 1.2188 |
| −0.0903 | −0.0800 | 1.2188 |
| −0.1553 | −0.0821 | 1.2188 |
| −0.2224 | −0.0903 | 1.2188 |
| −0.2916 | −0.1053 | 1.2188 |
| −0.3599 | −0.1266 | 1.2188 |
| −0.4239 | −0.1525 | 1.2188 |
| −0.4823 | −0.1808 | 1.2188 |
| −0.5359 | −0.2105 | 1.2188 |
| −0.5859 | −0.2409 | 1.2188 |
| −0.6333 | −0.2715 | 1.2188 |
| −0.6792 | −0.3023 | 1.2188 |
| −0.7250 | −0.3333 | 1.2188 |
| −0.7714 | −0.3647 | 1.2188 |
| −0.7834 | −0.3728 | 1.2188 |
| −0.7951 | −0.3806 | 1.2188 |
| −0.8070 | −0.3883 | 1.2188 |
| −0.8195 | −0.3961 | 1.2188 |
| −0.8327 | −0.4039 | 1.2188 |
| −0.8467 | −0.4114 | 1.2188 |
| −0.8614 | −0.4183 | 1.2188 |
| −0.8767 | −0.4242 | 1.2188 |
| −0.8924 | −0.4288 | 1.2188 |
| −0.9080 | −0.4316 | 1.2188 |
| −0.9229 | −0.4326 | 1.2188 |
| −0.9370 | −0.4319 | 1.2188 |
| −0.9504 | −0.4296 | 1.2188 |
| −0.9631 | −0.4255 | 1.2188 |
| −0.9745 | −0.4198 | 1.2188 |
| −0.9843 | −0.4129 | 1.2188 |
| −0.9925 | −0.4049 | 1.2188 |
| −0.9994 | −0.3957 | 1.2188 |
| −1.0052 | −0.3850 | 1.2188 |
| −1.0098 | −0.3724 | 1.2188 |
| −1.0132 | −0.3580 | 1.2188 |
| −1.0152 | −0.3430 | 1.2188 |
| −1.0161 | −0.3279 | 1.2188 |
| −1.0160 | −0.3128 | 1.2188 |
| −1.0153 | −0.2977 | 1.2188 |
| −1.0141 | −0.2828 | 1.2188 |
| −1.0126 | −0.2680 | 1.2188 |
| −1.0109 | −0.2534 | 1.2188 |
| −1.0089 | −0.2390 | 1.2188 |
| −1.0066 | −0.2246 | 1.2188 |
| −1.0041 | −0.2102 | 1.2188 |
| −0.9903 | −0.1447 | 1.2188 |
| −0.9727 | −0.0801 | 1.2188 |
| −0.9513 | −0.0168 | 1.2188 |
| −0.9262 | 0.0449 | 1.2188 |
| −0.8979 | 0.1050 | 1.2188 |

TABLE 1-continued

| X | Y | Z |
|---|---|---|
| −0.8663 | 0.1633 | 1.2188 |
| −0.8316 | 0.2198 | 1.2188 |
| −0.7940 | 0.2744 | 1.2188 |
| −0.7536 | 0.3267 | 1.2188 |
| 0.7106 | 0.3764 | 1.2188 |
| −0.6653 | 0.4237 | 1.2188 |
| −0.6173 | 0.4682 | 1.2188 |
| −0.5665 | 0.5098 | 1.2188 |
| −0.5130 | 0.5479 | 1.2188 |
| −0.4578 | 0.5819 | 1.2188 |
| −0.4007 | 0.6112 | 1.2188 |
| −0.3409 | 0.6361 | 1.2188 |
| −0.2794 | 0.6556 | 1.2188 |
| −0.2194 | 0.6689 | 1.2188 |
| −0.1608 | 0.6764 | 1.2188 |
| −0.1024 | 0.6787 | 1.2188 |
| −0.0437 | 0.6756 | 1.2188 |
| 0.0150 | 0.6672 | 1.2188 |
| 0.0731 | 0.6533 | 1.2188 |
| 0.1302 | 0.6343 | 1.2188 |
| 0.1848 | 0.6110 | 1.2188 |
| 0.2357 | 0.5847 | 1.2188 |
| 0.2836 | 0.5557 | 1.2188 |
| 0.3299 | 0.5236 | 1.2188 |
| 0.3758 | 0.4874 | 1.2188 |
| 0.4218 | 0.4463 | 1.2188 |
| 0.4667 | 0.4014 | 1.2188 |
| 0.5090 | 0.3545 | 1.2188 |
| 0.5485 | 0.3065 | 1.2188 |
| 0.5860 | 0.2571 | 1.2188 |
| 0.6233 | 0.2039 | 1.2188 |
| 0.6619 | 0.1444 | 1.2188 |
| 0.7031 | 0.0755 | 1.2188 |
| 0.7469 | −0.0037 | 1.2188 |
| 0.7926 | −0.0935 | 1.2188 |
| 0.8402 | −0.1943 | 1.2188 |
| 0.8899 | −0.3073 | 1.2188 |
| 0.9426 | −0.4338 | 1.2188 |
| 0.9986 | −0.5749 | 1.2188 |
| 1.0583 | −0.7314 | 1.2188 |
| 1.1226 | −0.9038 | 1.2188 |
| 1.1266 | −0.9150 | 1.2188 |
| 1.1302 | −0.9261 | 1.2188 |
| 1.1328 | −0.9371 | 1.2188 |
| 1.1342 | −0.9478 | 1.2188 |
| 1.1342 | −0.9579 | 1.2188 |
| 1.1329 | −0.9677 | 1.2188 |
| 1.1300 | −0.9772 | 1.2188 |
| 1.1256 | −0.9863 | 1.2188 |
| 1.1196 | −0.9948 | 1.2188 |
| 1.1123 | −1.0024 | 1.2188 |
| 1.1040 | −1.0088 | 1.2188 |
| 1.0949 | −1.0139 | 1.2188 |
| 1.0853 | −1.0177 | 1.2188 |
| 1.0753 | −1.0200 | 1.2188 |
| 1.0650 | −1.0209 | 1.2188 |
| 1.0547 | −1.0201 | 1.2188 |
| 1.0450 | −1.0176 | 1.2188 |
| 1.0360 | −1.0138 | 1.2188 |
| 1.0278 | −1.0086 | 1.2188 |
| 1.0201 | −1.0021 | 1.2188 |
| 1.0130 | −0.9944 | 1.2188 |
| 1.0064 | −0.9857 | 1.2188 |
| 1.0002 | −0.9763 | 1.2188 |
| 0.9942 | −0.9665 | 1.2188 |
| 0.9750 | −0.9891 | 1.4625 |
| 0.8692 | −0.8172 | 1.4625 |
| 0.7701 | −0.6694 | 1.4625 |
| 0.6764 | −0.5438 | 1.4625 |
| 0.5876 | −0.4388 | 1.4625 |
| 0.5035 | −0.3524 | 1.4625 |
| 0.4240 | −0.2820 | 1.4625 |
| 0.3483 | −0.2249 | 1.4625 |
| 0.2752 | −0.1786 | 1.4625 |
| 0.2046 | −0.1418 | 1.4625 |
| 0.1359 | −0.1131 | 1.4625 |
| 0.0682 | −0.0916 | 1.4625 |

TABLE 1-continued

| X | Y | Z |
|---|---|---|
| 0.0009 | −0.0767 | 1.4625 |
| −0.0665 | −0.0682 | 1.4625 |
| −0.1330 | −0.0661 | 1.4625 |
| −0.1966 | −0.0699 | 1.4625 |
| −0.2562 | −0.0787 | 1.4625 |
| −0.3126 | −0.0918 | 1.4625 |
| −0.3668 | −0.1087 | 1.4625 |
| −0.4197 | −0.1294 | 1.4625 |
| −0.4720 | −0.1536 | 1.4625 |
| −0.5231 | −0.1808 | 1.4625 |
| −0.5727 | −0.2101 | 1.4625 |
| −0.6206 | −0.2406 | 1.4625 |
| −0.6674 | −0.2718 | 1.4625 |
| −0.7141 | −0.3034 | 1.4625 |
| −0.7613 | −0.3356 | 1.4625 |
| −0.7730 | −0.3437 | 1.4625 |
| −0.7846 | −0.3515 | 1.4625 |
| −0.7963 | −0.3592 | 1.4625 |
| −0.8085 | −0.3671 | 1.4625 |
| −0.8215 | −0.3749 | 1.4625 |
| −0.8352 | −0.3825 | 1.4625 |
| −0.8495 | −0.3896 | 1.4625 |
| −0.8645 | −0.3957 | 1.4625 |
| −0.8798 | −0.4005 | 1.4625 |
| −0.8951 | −0.4035 | 1.4625 |
| −0.9096 | −0.4047 | 1.4625 |
| −0.9233 | −0.4041 | 1.4625 |
| −0.9363 | −0.4019 | 1.4625 |
| −0.9487 | −0.3980 | 1.4625 |
| −0.9599 | −0.3925 | 1.4625 |
| −0.9695 | −0.3857 | 1.4625 |
| −0.9777 | −0.3778 | 1.4625 |
| −0.9846 | −0.3687 | 1.4625 |
| −0.9903 | −0.3582 | 1.4625 |
| −0.9949 | −0.3458 | 1.4625 |
| −0.9983 | −0.3318 | 1.4625 |
| −1.0003 | −0.3171 | 1.4625 |
| −1.0012 | −0.3022 | 1.4625 |
| −1.0012 | −0.2874 | 1.4625 |
| −1.0006 | −0.2725 | 1.4625 |
| −0.9996 | −0.2578 | 1.4625 |
| −0.9982 | −0.2433 | 1.4625 |
| −0.9966 | −0.2289 | 1.4625 |
| −0.9947 | −0.2147 | 1.4625 |
| −0.9926 | −0.2005 | 1.4625 |
| −0.9903 | −0.1862 | 1.4625 |
| −0.9770 | −0.1211 | 1.4625 |
| −0.9599 | −0.0569 | 1.4625 |
| −0.9388 | 0.0062 | 1.4625 |
| −0.9139 | 0.0678 | 1.4625 |
| −0.8857 | 0.1278 | 1.4625 |
| −0.8541 | 0.1859 | 1.4625 |
| −0.8194 | 0.2419 | 1.4625 |
| −0.7816 | 0.2959 | 1.4625 |
| −0.7410 | 0.3474 | 1.4625 |
| −0.6976 | 0.3964 | 1.4625 |
| −0.6517 | 0.4425 | 1.4625 |
| −0.6031 | 0.4857 | 1.4625 |
| −0.5514 | 0.5259 | 1.4625 |
| −0.4970 | 0.5623 | 1.4625 |
| −0.4417 | 0.5937 | 1.4625 |
| −0.3862 | 0.6197 | 1.4625 |
| −0.3302 | 0.6408 | 1.4625 |
| −0.2736 | 0.6570 | 1.4625 |
| −0.2159 | 0.6681 | 1.4625 |
| −0.1567 | 0.6741 | 1.4625 |
| −0.0969 | 0.6747 | 1.4625 |
| −0.0373 | 0.6696 | 1.4625 |
| 0.0214 | 0.6592 | 1.4625 |
| 0.0792 | 0.6433 | 1.4625 |
| 0.1359 | 0.6223 | 1.4625 |
| 0.1899 | 0.5970 | 1.4625 |
| 0.2400 | 0.5690 | 1.4625 |
| 0.2868 | 0.5385 | 1.4825 |
| 0.3320 | 0.5051 | 1.4625 |
| 0.3766 | 0.4677 | 1.4625 |
| 0.4213 | 0.4255 | 1.4625 |

TABLE 1-continued

| X | Y | Z |
|---|---|---|
| 0.4650 | 0.3795 | 1.4625 |
| 0.5061 | 0.3317 | 1.4625 |
| 0.5445 | 0.2828 | 1.4625 |
| 0.5809 | 0.2327 | 1.4625 |
| 0.6170 | 0.1789 | 1.4625 |
| 0.6546 | 0.1187 | 1.4625 |
| 0.6946 | 0.0493 | 1.4625 |
| 0.7370 | −0.0304 | 1.4625 |
| 0.7814 | −0.1204 | 1.4625 |
| 0.8276 | −0.2213 | 1.4625 |
| 0.8761 | −0.3342 | 1.4625 |
| 0.9275 | −0.4603 | 1.4625 |
| 0.9822 | −0.6007 | 1.4625 |
| 1.0407 | −0.7562 | 1.4625 |
| 1.1037 | −0.9274 | 1.4625 |
| 1.1077 | −0.9386 | 1.4625 |
| 1.1112 | −0.9497 | 1.4625 |
| 1.1138 | −0.9607 | 1.4825 |
| 1.1151 | −0.9714 | 1.4625 |
| 1.1151 | −0.9815 | 1.4625 |
| 1.1137 | 0.9912 | 1.4625 |
| 1.1108 | −1.0007 | 1.4625 |
| 1.1063 | −1.0098 | 1.4625 |
| 1.1003 | −1.0182 | 1.4625 |
| 1.0929 | −1.0258 | 1.4625 |
| 1.0846 | −1.0321 | 1.4625 |
| 1.0755 | −1.0371 | 1.4625 |
| 1.0658 | −1.0408 | 1.4625 |
| 1.0558 | −1.0431 | 1.4625 |
| 1.0454 | −1.0439 | 1.4625 |
| 1.0352 | −1.0430 | 1.4625 |
| 1.0255 | −1.0405 | 1.4625 |
| 1.0165 | −1.0366 | 1.4625 |
| 1.0082 | −1.0313 | 1.4625 |
| 1.0006 | −1.0248 | 1.4625 |
| 0.9936 | −1.0171 | 1.4625 |
| 0.9870 | −1.0083 | 1.4625 |
| 0.9808 | −0.9988 | 1.4625 |
| 0.9750 | −0.9891 | 1.4625 |
| 0.9556 | −1.0102 | 1.7063 |
| 0.8503 | −0.8356 | 1.7063 |
| 0.7519 | −0.6846 | 1.7063 |
| 0.6590 | −0.5555 | 1.7063 |
| 0.5708 | −0.4466 | 1.7063 |
| 0.4874 | −.3568 | 1.7063 |
| 0.4088 | −0.2836 | 1.7063 |
| 0.3342 | −0.2243 | 1.7063 |
| 0.2627 | −0.1763 | 1.7063 |
| 0.1939 | −0.1379 | 1.7063 |
| 0.1268 | −0.1077 | 1.7063 |
| 0.0608 | −0.0847 | 1.7063 |
| −0.0046 | −0.0682 | 1.7063 |
| −0.0700 | −0.0580 | 1.7063 |
| −0.1340 | −0.0540 | 1.7063 |
| −0.1952 | 0.0558 | 1.7063 |
| −0.2528 | −0.0626 | 1.7063 |
| −0.3078 | −0.0737 | 1.7063 |
| −0.3610 | −0.0888 | 1.7063 |
| −0.4134 | −0.1078 | 1.7063 |
| −0.4654 | −0.1307 | 1.7063 |
| −0.5161 | −0.1567 | 1.7063 |
| −0.5653 | −0.1850 | 1.7063 |
| −0.6126 | −0.2146 | 1.7063 |
| −0.6589 | −0.2450 | 1.7063 |
| −0.7048 | −0.2761 | 1.7063 |
| −0.7512 | −0.3078 | 1.7063 |
| −0.7628 | −0.3158 | 1.7063 |
| −0.7741 | −0.3235 | 1.7063 |
| −0.7856 | −0.3312 | 1.7063 |
| −0.7976 | −0.3390 | 1.7063 |
| −0.8103 | −0.3469 | 1.7063 |
| −0.8237 | −0.3545 | 1.7063 |
| −0.8377 | −0.3617 | 1.7063 |
| −0.8523 | −0.3679 | 1.7063 |
| −0.8673 | −0.3728 | 1.7063 |
| −0.8822 | −0.3760 | 1.7063 |
| −0.8963 | −0.3772 | 1.7063 |

TABLE 1-continued

| X | Y | Z |
|---|---|---|
| −0.9096 | −0.3768 | 1.7063 |
| −0.9221 | −0.3747 | 1.7063 |
| −0.9342 | −0.3708 | 1.7063 |
| −0.9452 | −0.3654 | 1.7063 |
| −0.9547 | −0.3587 | 1.7063 |
| −0.9629 | −0.3508 | 1.7063 |
| −0.9697 | −0.3417 | 1.7063 |
| −0.9754 | −0.3313 | 1.7063 |
| −0.9799 | −0.3191 | 1.7063 |
| −0.9832 | −0.3054 | 1.7063 |
| −0.9853 | −0.2911 | 1.7063 |
| −0.9862 | −0.2766 | 1.7063 |
| −0.9863 | −0.2620 | 1.7063 |
| −0.9857 | −0.2475 | 1.7063 |
| −0.9848 | −0.2330 | 1.7063 |
| −0.9835 | −0.2187 | 1.7063 |
| −0.9820 | −0.2046 | 1.7063 |
| −0.9802 | −0.1906 | 1.7063 |
| −0.9782 | −0.1756 | 1.7063 |
| −0.9759 | −0.1626 | 1.7063 |
| −0.9630 | −0.0980 | 1.7063 |
| −0.9461 | −0.0344 | 1.7063 |
| −0.9253 | 0.0281 | 1.7063 |
| −0.9008 | 0.0892 | 1.7063 |
| −0.8727 | 0.1486 | 1.7063 |
| −0.8413 | 0.2061 | 1.7063 |
| −0.8067 | 0.2615 | 1.7063 |
| −0.7689 | 0.3147 | 1.7063 |
| −0.7281 | 0.3654 | 1.7063 |
| −0.6845 | 0.4133 | 1.7063 |
| −0.6382 | 0.4583 | 1.7063 |
| −0.5890 | 0.5001 | 1.7063 |
| −0.5366 | 0.5385 | 1.7063 |
| −0.4816 | 0.5730 | 1.7063 |
| −0.4260 | 0.6020 | 1.7063 |
| −0.3703 | 0.6256 | 1.7063 |
| −0.3144 | 0.6441 | 1.7063 |
| −0.2578 | 0.6575 | 1.7063 |
| −0.1999 | 0.6660 | 1.7063 |
| −0.1402 | 0.6692 | 1.7063 |
| −0.0789 | 0.6667 | 1.7063 |
| −0.0165 | 0.6580 | 1.7063 |
| 0.0466 | 0.6428 | 1.7063 |
| 0.1094 | 0.6210 | 1.7063 |
| 0.1701 | 0.5933 | 1.7063 |
| 0.2271 | 0.5612 | 1.7063 |
| 0.2804 | 0.5255 | 1.7063 |
| 0.3304 | 0.4868 | 1.7063 |
| 0.3773 | 0.4455 | 1.7063 |
| 0.4215 | 0.4016 | 1.7063 |
| 0.4634 | 0.3553 | 1.7063 |
| 0.5032 | 0.3069 | 1.7063 |
| 0.5405 | 0.2574 | 1.7063 |
| 0.5758 | 0.2067 | 1.7063 |
| 0.6109 | 0.1525 | 1.7063 |
| 0.6472 | 0.0919 | 1.7063 |
| 0.6860 | 0.0221 | 1.7063 |
| 0.7272 | −0.0578 | 1.7063 |
| 0.7703 | −0.1480 | 1.7063 |
| 0.8153 | −0.2487 | 1.7063 |
| 0.8624 | −0.3613 | 1.7063 |
| 0.9125 | −0.4868 | 1.7063 |
| 0.9659 | −0.6261 | 1.7063 |
| 1.0231 | −0.7802 | 1.7063 |
| 1.0847 | −0.9497 | 1.7063 |
| 1.0886 | −0.9607 | 1.7063 |
| 1.0921 | −0.9719 | 1.7063 |
| 1.0946 | −0.9830 | 1.7063 |
| 1.0959 | −0.9936 | 1.7063 |
| 1.0959 | −1.0037 | 1.7063 |
| 1.0944 | −1.0133 | 1.7063 |
| 1.0915 | −1.0228 | 1.7063 |
| 1.0870 | −1.0318 | 1.7063 |
| 1.0809 | −1.0403 | 1.7063 |
| 1.0735 | −1.0477 | 1.7063 |
| 1.0651 | −1.0540 | 1.7063 |
| 1.0560 | −1.0590 | 1.7063 |

TABLE 1-continued

| X | Y | Z |
|---|---|---|
| 1.0463 | −1.0626 | 1.7063 |
| 1.0362 | −1.0648 | 1.7063 |
| 1.0258 | −1.0655 | 1.7063 |
| 1.0155 | −1.0646 | 1.7063 |
| 1.0058 | −1.0621 | 1.7063 |
| 0.9968 | −1.0580 | 1.7063 |
| 0.9886 | −1.0527 | 1.7063 |
| 0.9811 | −1.0462 | 1.7063 |
| 0.9740 | −1.0384 | 1.7063 |
| 0.9675 | −1.0295 | 1.7063 |
| 0.9614 | −1.0200 | 1.7063 |
| 0.9556 | −1.0102 | 1.7063 |
| 0.9362 | −1.0303 | 1.9500 |
| 0.8326 | −0.8549 | 1.9500 |
| 0.7359 | −0.7026 | 1.9500 |
| 0.6448 | −0.5715 | 1.9500 |
| 0.5584 | −0.4600 | 1.9500 |
| 0.4764 | −0.3672 | 1.9500 |
| 0.3988 | −0.2909 | 1.9500 |
| 0.3252 | −0.2287 | 1.9500 |
| 0.2547 | −0.1782 | 1.9500 |
| 0.1870 | −0.1376 | 1.9500 |
| 0.1211 | −0.1053 | 1.9500 |
| 0.0566 | −0.0804 | 1.9500 |
| −0.0073 | −0.0620 | 1.9500 |
| −0.0708 | −0.0499 | 1.9500 |
| −0.1328 | −0.0440 | 1.9500 |
| −0.1920 | −0.0437 | 1.9500 |
| −0.2481 | −0.0484 | 1.9500 |
| −0.3019 | −0.0575 | 1.9500 |
| −0.3544 | −0.0706 | 1.9500 |
| −0.4064 | −0.0880 | 1.9500 |
| −0.4581 | −0.1094 | 1.9500 |
| −0.5086 | −0.1341 | 1.9500 |
| −0.5574 | −0.1613 | 1.9500 |
| −0.6044 | −0.1899 | 1.9500 |
| −0.6501 | −0.2195 | 1.9500 |
| −0.6955 | −0.2499 | 1.9500 |
| −0.7412 | −0.2810 | 1.9500 |
| −0.7526 | −0.2888 | 1.9500 |
| −0.7638 | −0.2965 | 1.9500 |
| −0.7751 | −0.3041 | 1.9500 |
| −0.7868 | −0.3118 | 1.9500 |
| −0.7993 | −0.3196 | 1.9500 |
| −0.8124 | −0.3272 | 1.9500 |
| −0.8261 | −0.3344 | 1.9500 |
| −0.8403 | −0.3407 | 1.9500 |
| −0.8550 | −0.3457 | 1.9500 |
| −0.8695 | −0.3489 | 1.9500 |
| −0.8832 | −0.3501 | 1.9500 |
| −0.8960 | −0.3497 | 1.9500 |
| −0.9081 | −0.3476 | 1.9500 |
| −0.9197 | −0.3438 | 1.9500 |
| −0.9305 | −0.3384 | 1.9500 |
| −0.9399 | −0.3316 | 1.9500 |
| −0.9481 | −0.3237 | 1.9500 |
| −0.9548 | −0.3146 | 1.9500 |
| −0.9604 | −0.3042 | 1.9500 |
| −0.9649 | −0.2923 | 1.9500 |
| −0.9681 | −0.2789 | 1.9500 |
| −0.9701 | −0.2649 | 1.9500 |
| −0.9710 | −0.2507 | 1.9500 |
| −0.9711 | −0.2366 | 1.9500 |
| −0.9706 | −0.2224 | 1.9500 |
| −0.9697 | −0.2083 | 1.9500 |
| −0.9685 | −0.1943 | 1.9500 |
| −0.9670 | −0.1804 | 1.9500 |
| −0.9652 | −0.1667 | 1.9500 |
| −0.9633 | −0.1530 | 1.9500 |
| −0.9611 | −0.1392 | 1.9500 |
| −0.9486 | −0.0764 | 1.9500 |
| −0.9322 | −0.0144 | 1.9500 |
| −0.9121 | 0.0464 | 1.9500 |
| −0.8883 | 0.1059 | 1.9500 |
| −0.8612 | 0.1639 | 1.9500 |
| −0.8307 | 0.2199 | 1.9500 |
| −0.7971 | 0.2738 | 1.9500 |

TABLE 1-continued

| X | Y | Z |
|---|---|---|
| −0.7603 | 0.3255 | 1.9500 |
| −0.7204 | 0.3749 | 1.9500 |
| −0.6777 | 0.4213 | 1.9500 |
| −0.6322 | 0.4648 | 1.9500 |
| −0.5839 | 0.5050 | 1.9500 |
| −0.5324 | 0.5418 | 1.9500 |
| −0.4781 | 0.5746 | 1.9500 |
| −0.4230 | 0.6021 | 1.9500 |
| −0.3683 | 0.6240 | 1.9500 |
| −0.3135 | 0.6409 | 1.9500 |
| −0.2581 | 0.6529 | 1.9500 |
| −0.2014 | 0.6600 | 1.9500 |
| −0.1427 | 0.6620 | 1.9500 |
| −0.0828 | 0.6584 | 1.9500 |
| −0.0225 | 0.6489 | 1.9500 |
| 0.0375 | 0.6336 | 1.9500 |
| 0.0975 | 0.6122 | 1.9500 |
| 0.1579 | 0.5842 | 1.9500 |
| 0.2185 | 0.5492 | 1.9500 |
| 0.2799 | 0.5064 | 1.9500 |
| 0.3423 | 0.4547 | 1.9500 |
| 0.4055 | 0.3930 | 1.9500 |
| 0.4699 | 0.3192 | 1.9500 |
| 0.5364 | 0.2305 | 1.9500 |
| 0.6052 | 0.1239 | 1.9500 |
| 0.6755 | −0.0022 | 1.9500 |
| 0.7472 | −0.1494 | 1.9500 |
| 0.8206 | −0.3192 | 1.9500 |
| 0.8971 | −0.5123 | 1.9500 |
| 0.9784 | −0.7294 | 1.9500 |
| 1.0657 | −0.9707 | 1.9500 |
| 1.0695 | −0.9818 | 1.9500 |
| 1.0729 | −0.9929 | 1.9500 |
| 1.0755 | −1.0040 | 1.9500 |
| 1.0767 | −1.0146 | 1.9500 |
| 1.0766 | −1.0247 | 1.9500 |
| 1.0752 | −1.0343 | 1.9500 |
| 1.0722 | −1.0437 | 1.9500 |
| 1.0676 | −1.0527 | 1.9500 |
| 1.0615 | −1.0611 | 1.9500 |
| 1.0540 | −1.0685 | 1.9500 |
| 1.0456 | −1.0747 | 1.9500 |
| 1.0364 | −1.0797 | 1.9500 |
| 1.0267 | −1.0832 | 1.9500 |
| 1.0165 | −1.0854 | 1.9500 |
| 1.0061 | −1.0860 | 1.9500 |
| 0.9959 | −1.0850 | 1.9500 |
| 0.9861 | −1.0824 | 1.9500 |
| 0.9772 | −1.0784 | 1.9500 |
| 0.9690 | −1.0730 | 1.9500 |
| 0.9615 | −1.0664 | 1.9500 |
| 0.9544 | −1.0585 | 1.9500 |
| 0.9480 | −1.0496 | 1.9500 |
| 0.9420 | −1.0401 | 1.9500 |
| 0.9362 | −1.0303 | 1.9500 |
| 0.9167 | −1.0494 | 2.1938 |
| 0.8146 | −0.8734 | 2.1938 |
| 0.7195 | −0.7199 | 2.1938 |
| 0.6300 | −0.5868 | 2.1938 |
| 0.5450 | −0.4730 | 2.1938 |
| 0.4843 | −0.3774 | 2.1938 |
| 0.3877 | −0.2982 | 2.1938 |
| 0.3149 | −0.2333 | 2.1938 |
| 0.2454 | −0.1804 | 2.1938 |
| 0.1788 | −0.1378 | 2.1938 |
| 0.1142 | −0.1037 | 2.1938 |
| 0.0512 | −0.0771 | 2.1938 |
| −0.0111 | −0.0570 | 2.1938 |
| −0.0727 | −0.0432 | 2.1938 |
| −0.1327 | −0.0354 | 2.1938 |
| −0.1899 | −0.0333 | 2.1938 |
| −0.2444 | −0.0360 | 2.1938 |
| −0.2970 | −0.0431 | 2.1938 |
| −0.3486 | −0.0544 | 2.1938 |
| −0.4000 | −0.0701 | 2.1938 |
| −0.4514 | −0.0899 | 2.1938 |
| −0.5016 | −0.1132 | 2.1938 |

TABLE 1-continued

| X | Y | Z |
|---|---|---|
| −0.5499 | −0.1391 | 2.1938 |
| −0.5964 | −0.1666 | 2.1938 |
| −0.6416 | −0.1952 | 2.1938 |
| −0.6864 | −0.2247 | 2.1938 |
| −0.7314 | −0.2551 | 2.1938 |
| −0.7426 | −0.2627 | 2.1938 |
| −0.7535 | −0.2702 | 2.1938 |
| −0.7646 | −0.2776 | 2.1938 |
| −0.7761 | −0.2852 | 2.1938 |
| −0.7883 | −0.2929 | 2.1938 |
| −0.8011 | −0.3005 | 2.1938 |
| −0.8145 | −0.3076 | 2.1938 |
| −0.8284 | −0.3139 | 2.1938 |
| −0.8427 | −0.3188 | 2.1938 |
| −0.8568 | −0.3220 | 2.1938 |
| −0.8702 | −0.3232 | 2.1938 |
| −0.8825 | −0.3227 | 2.1938 |
| −0.8941 | −0.3206 | 2.1938 |
| −0.9054 | −0.3168 | 2.1938 |
| −0.9159 | −0.3114 | 2.1938 |
| −0.9252 | −0.3046 | 2.1938 |
| −0.9332 | −0.2965 | 2.1938 |
| −0.9399 | −0.2874 | 2.1938 |
| −0.9454 | −0.2771 | 2.1938 |
| −0.9498 | −0.2653 | 2.1938 |
| −0.9529 | −0.2522 | 2.1938 |
| −0.9548 | −0.2386 | 2.1938 |
| −0.9557 | −0.2249 | 2.1938 |
| −0.9558 | −0.2111 | 2.1938 |
| −0.9553 | −0.1974 | 2.1938 |
| −0.9544 | −0.1837 | 2.1938 |
| −0.9532 | −0.1700 | 2.1938 |
| −0.9517 | −0.1564 | 2.1938 |
| −0.9500 | −0.1430 | 2.1938 |
| −0.9480 | −0.1295 | 2.1938 |
| −0.9459 | −0.1161 | 2.1938 |
| −0.9333 | −0.0534 | 2.1938 |
| −0.9171 | 0.0073 | 2.1938 |
| −0.8971 | 0.0671 | 2.1938 |
| −0.8729 | 0.1271 | 2.1938 |
| −0.8442 | 0.1873 | 2.1938 |
| −0.8110 | 0.2467 | 2.1938 |
| −0.7736 | 0.3042 | 2.1938 |
| −0.7324 | 0.3588 | 2.1938 |
| −0.6880 | 0.4096 | 2.1938 |
| −0.6415 | 0.4558 | 2.1938 |
| −0.5938 | 0.4967 | 2.1938 |
| −0.5444 | 0.5330 | 2.1938 |
| −0.4920 | 0.5655 | 2.1938 |
| −0.4372 | 0.5936 | 2.1938 |
| −0.3824 | 0.6160 | 2.1938 |
| −0.3277 | 0.6330 | 2.1938 |
| 0.2726 | 0.6451 | 2.1938 |
| −0.2166 | 0.6522 | 2.1938 |
| −0.1590 | 0.6543 | 2.1938 |
| −0.0998 | 0.6508 | 2.1938 |
| −0.0398 | 0.6415 | 2.1938 |
| 0.0202 | 0.6263 | 2.1938 |
| 0.0801 | 0.6049 | 2.1938 |
| 0.1403 | 0.5771 | 2.1938 |
| 0.2010 | 0.5421 | 2.1938 |
| 0.2621 | 0.4994 | 2.1938 |
| 0.3244 | 0.4476 | 2.1938 |
| 0.3878 | 0.3854 | 2.1938 |
| 0.4524 | 0.3110 | 2.1938 |
| 0.5190 | 0.2215 | 2.1938 |
| 0.5877 | 0.1140 | 2.1938 |
| 0.6578 | −0.0133 | 2.1938 |
| 0.7291 | −0.1621 | 2.1938 |
| 0.8021 | −0.3336 | 2.1938 |
| 0.8782 | −0.5286 | 2.1938 |
| 0.9593 | −0.7474 | 2.1938 |
| 1.0465 | −0.9907 | 2.1938 |
| 1.0504 | −1.0018 | 2.1938 |
| 1.0537 | −1.0130 | 2.1938 |
| 1.0562 | −1.0240 | 2.1938 |
| 1.0574 | −1.0346 | 2.1938 |

TABLE 1-continued

| X | Y | Z |
|---|---|---|
| 1.0573 | −1.0447 | 2.1938 |
| 1.0558 | −1.0543 | 2.1938 |
| 1.0528 | −1.0636 | 2.1938 |
| 1.0482 | −1.0726 | 2.1938 |
| 1.0420 | −1.0810 | 2.1938 |
| 1.0345 | −1.0884 | 2.1938 |
| 1.260 | −1.0945 | 2.1938 |
| 1.0168 | −1.0994 | 2.1938 |
| 1.0071 | −1.1029 | 2.1938 |
| 0.9969 | −1.1050 | 2.1938 |
| 0.9864 | −1.1056 | 2.1938 |
| 0.9761 | −1.1045 | 2.1938 |
| 0.9664 | −1.1019 | 2.1938 |
| 0.9574 | −1.0978 | 2.1938 |
| 0.9493 | −1.0923 | 2.1938 |
| 0.9418 | −1.0857 | 2.1938 |
| 0.9348 | −1.0778 | 2.1938 |
| 0.9284 | −1.0688 | 2.1938 |
| 0.9224 | −1.0592 | 2.1938 |
| 0.9167 | −1.0494 | 2.1938 |
| 0.8973 | −1.0678 | 2.4375 |
| 0.7964 | −0.8912 | 2.4375 |
| 0.7026 | −0.7364 | 2.4375 |
| 0.6144 | −0.6015 | 2.4375 |
| 0.5307 | −0.4854 | 2.4375 |
| 0.4511 | −0.3870 | 2.4375 |
| 0.3753 | −0.3049 | 2.4375 |
| 0.3033 | −0.2375 | 2.4375 |
| 0.2349 | −0.1825 | 2.4375 |
| 0.1695 | −0.1381 | 2.4375 |
| 0.1063 | −0.1023 | 2.4375 |
| 0.0448 | −0.0741 | 2.4375 |
| −0.0158 | −0.0526 | 2.4375 |
| −0.0755 | −0.0372 | 2.4375 |
| −0.1334 | −0.0278 | 2.4375 |
| −0.1886 | −0.0238 | 2.4375 |
| −0.2415 | −0.0247 | 2.4375 |
| −0.2928 | −0.0300 | 2.4375 |
| −0.3434 | −0.0395 | 2.4375 |
| −0.3943 | −0.0534 | 2.4375 |
| −0.4452 | −0.0716 | 2.4375 |
| −0.4948 | −0.0934 | 2.4375 |
| −0.5426 | −0.1179 | 2.4375 |
| −0.5885 | −0.1442 | 2.4375 |
| −0.6332 | −0.1718 | 2.4375 |
| −0.6773 | −0.2003 | 2.4375 |
| −0.7215 | −0.2297 | 2.4375 |
| −0.7329 | −0.2374 | 2.4375 |
| −0.7440 | −0.2449 | 2.4375 |
| −0.7553 | −0.2524 | 2.4375 |
| −0.7670 | −0.2601 | 2.4375 |
| −0.7794 | −0.2679 | 2.4375 |
| −0.7925 | −0.2755 | 2.4375 |
| −0.8061 | −0.2826 | 2.4375 |
| −0.8202 | −0.2886 | 2.4375 |
| −0.8345 | −0.2932 | 2.4375 |
| −0.8485 | −0.2957 | 2.4375 |
| −0.8615 | −0.2963 | 2.4375 |
| −0.8735 | −0.2950 | 2.4375 |
| −0.8849 | −0.2921 | 2.4375 |
| −0.8959 | −0.2874 | 2.4375 |
| −0.9059 | −0.2811 | 2.4375 |
| −0.9148 | −0.2732 | 2.4375 |
| −0.9223 | −0.2642 | 2.4375 |
| −0.9283 | −0.2541 | 2.4375 |
| −0.9331 | −0.2427 | 2.4375 |
| −0.9367 | −0.2299 | 2.4375 |
| −0.9390 | −0.2163 | 2.4375 |
| −0.9401 | −0.2026 | 2.4375 |
| −0.9403 | −0.1888 | 2.4375 |
| −0.9400 | −0.1751 | 2.4375 |
| −0.9391 | −0.1613 | 2.4375 |
| −0.9379 | −0.1476 | 2.4375 |
| −0.9364 | −0.1339 | 2.4375 |
| −0.9346 | −0.1202 | 2.4375 |
| −0.9326 | −0.1067 | 2.4375 |
| −0.9304 | −0.0931 | 2.4375 |

TABLE 1-continued

| X | Y | Z |
|---|---|---|
| −0.9181 | −0.0323 | 2.4375 |
| −0.9019 | 0.0274 | 2.4375 |
| −0.8821 | 0.0861 | 2.4375 |
| −0.8588 | 0.1436 | 2.4375 |
| −0.8316 | 0.2004 | 2.4375 |
| −0.7998 | 0.2572 | 2.4375 |
| −0.7624 | 0.3147 | 2.4375 |
| −0.7180 | 0.3727 | 2.4375 |
| −0.6675 | 0.4285 | 2.4375 |
| −0.6134 | 0.4789 | 2.4375 |
| −0.5583 | 0.5217 | 2.4375 |
| −0.5029 | 0.5574 | 2.4375 |
| −0.4472 | 0.5865 | 2.4375 |
| −0.3912 | 0.5696 | 2.4375 |
| −0.3343 | 0.6272 | 2.4375 |
| −0.2767 | 0.6392 | 2.4375 |
| −0.2190 | 0.6457 | 2.4375 |
| −0.1613 | 0.6466 | 2.4375 |
| −0.1033 | 0.6421 | 2.4375 |
| −0.0450 | 0.6319 | 2.4375 |
| 0.0134 | 0.6160 | 2.4375 |
| 0.0721 | 0.5940 | 2.4375 |
| 0.1315 | 0.5655 | 2.4375 |
| 0.1915 | 0.5298 | 2.4375 |
| 0.2520 | 0.4864 | 2.4375 |
| 0.3135 | 0.4339 | 2.4375 |
| 0.3763 | 0.3708 | 2.4375 |
| 0.4406 | 0.2953 | 2.4375 |
| 0.5066 | 0.2046 | 2.4375 |
| 0.5745 | 0.0960 | 2.4375 |
| 0.6437 | −0.0324 | 2.4375 |
| 0.7140 | −0.1820 | 2.4375 |
| 0.7860 | −0.3542 | 2.4375 |
| 0.8610 | −0.5493 | 2.4375 |
| 0.9410 | −0.7675 | 2.4375 |
| 1.0274 | −1.0101 | 2.4375 |
| 1.0311 | −1.0211 | 2.4375 |
| 1.0345 | −1.0323 | 2.4375 |
| 1.0370 | −1.0433 | 2.4375 |
| 1.0381 | −1.0540 | 2.4375 |
| 1.0380 | −1.0640 | 2.4375 |
| 1.0365 | −1.0735 | 2.4375 |
| 1.0334 | −1.0829 | 2.4375 |
| 1.0288 | −1.0918 | 2.4375 |
| 1.0226 | −1.1002 | 2.4375 |
| 1.0150 | −1.1075 | 2.4375 |
| 1.0065 | −1.1136 | 2.4375 |
| 0.9972 | −1.1185 | 2.4375 |
| 0.9874 | −1.1219 | 2.4375 |
| 0.9772 | −1.1240 | 2.4375 |
| 0.9667 | −1.1245 | 2.4375 |
| 0.9564 | −1.1234 | 2.4375 |
| 0.9467 | −1.1207 | 2.4375 |
| 0.9377 | −1.1165 | 2.4375 |
| 0.9296 | −1.1110 | 2.4375 |
| 0.9221 | −1.1043 | 2.4375 |
| 0.9152 | −1.0964 | 2.4375 |
| 0.9088 | −1.0874 | 2.4375 |
| 0.9029 | −1.0777 | 2.4375 |
| 0.8973 | −1.0678 | 2.4375 |
| 0.8778 | −1.0859 | 2.6813 |
| 0.7741 | −0.9017 | 2.6813 |
| 0.6780 | −0.7403 | 2.6813 |
| 0.5879 | −0.5999 | 2.6813 |
| 0.5026 | −0.4792 | 2.6813 |
| 0.4213 | −0.3772 | 2.6813 |
| 0.3441 | −0.2925 | 2.6813 |
| 0.2712 | −0.2236 | 2.6813 |
| 0.2023 | −0.1680 | 2.6813 |
| 0.1365 | −0.1234 | 2.6813 |
| 0.0731 | −0.0878 | 2.6813 |
| 0.0114 | −0.0601 | 2.6813 |
| −0.0493 | −0.0392 | 2.6813 |
| −0.1084 | −0.0249 | 2.6813 |
| −0.1650 | −0.0167 | 2.6813 |
| −0.2189 | −0.0139 | 2.6813 |
| −0.2713 | −0.0159 | 2.6813 |

TABLE 1-continued

| X | Y | Z |
|---|---|---|
| −0.3230 | −0.0224 | 2.6813 |
| −0.3749 | −0.0337 | 2.6813 |
| −0.4274 | −0.0498 | 2.6813 |
| −0.4787 | −0.0701 | 2.6813 |
| −0.5281 | −0.0936 | 2.6813 |
| −0.5755 | −0.1194 | 2.6813 |
| −0.6214 | −0.1467 | 2.6813 |
| −0.6666 | −0.1753 | 2.6813 |
| −0.7117 | −0.2048 | 2.6813 |
| −0.7227 | 0.2122 | 2.6813 |
| −0.7335 | −0.2193 | 2.6813 |
| −0.7444 | −0.2265 | 2.6813 |
| −0.7557 | −0.2338 | 2.6813 |
| −0.7676 | −0.2413 | 2.6813 |
| −0.7801 | −0.2486 | 2.6813 |
| −0.7931 | −0.2554 | 2.6813 |
| −0.8065 | −0.2613 | 2.6813 |
| −0.8202 | −0.2658 | 2.6813 |
| −0.8336 | −0.2685 | 2.6813 |
| −0.8462 | −0.2692 | 2.6813 |
| −0.8577 | −0.2682 | 2.6813 |
| −0.8687 | −0.2656 | 2.6813 |
| 0.8792 | −0.2613 | 2.6813 |
| −0.8892 | −0.2554 | 2.6813 |
| −0.8980 | −0.2479 | 2.6813 |
| −0.9056 | −0.2392 | 2.6813 |
| −0.9118 | −0.2296 | 2.6813 |
| −0.9167 | −0.2188 | 2.6813 |
| −0.9205 | −0.2067 | 2.6813 |
| −0.9230 | −0.1933 | 2.6813 |
| −0.9244 | −0.1793 | 2.6813 |
| −0.9247 | −0.1650 | 2.6813 |
| −0.9244 | −0.1507 | 2.6813 |
| −0.9234 | −0.1365 | 2.6813 |
| −0.9222 | −0.1227 | 2.6813 |
| −0.9206 | −0.1093 | 2.6813 |
| −0.9189 | −0.0963 | 2.6813 |
| −0.9169 | −0.0833 | 2.6813 |
| −0.9147 | −0.0702 | 2.6813 |
| −0.9024 | −0.0108 | 2.6813 |
| −0.8864 | 0.0476 | 2.6813 |
| −0.8667 | 0.1049 | 2.6813 |
| −0.8436 | 0.1610 | 2.6813 |
| −0.8169 | 0.2162 | 2.6813 |
| −0.7858 | 0.2711 | 2.6813 |
| −0.7494 | 0.3263 | 2.6813 |
| −0.7065 | 0.3816 | 2.6813 |
| −0.6579 | 0.4348 | 2.6813 |
| −0.6056 | 0.4829 | 2.6813 |
| −0.5521 | 0.5237 | 2.6813 |
| −0.4984 | 0.5576 | 2.6813 |
| −0.4445 | 0.5852 | 2.6813 |
| −0.3904 | 0.6069 | 2.6813 |
| −0.3353 | 0.6232 | 2.6813 |
| −0.2794 | 0.6342 | 2.6813 |
| −0.2232 | 0.6398 | 2.6813 |
| −0.1670 | 0.6400 | 2.6813 |
| −0.1103 | 0.6348 | 2.6813 |
| −0.0532 | 0.6240 | 2.6813 |
| 0.0042 | 0.6075 | 2.6813 |
| 0.0618 | 0.5851 | 2.6813 |
| 0.1202 | 0.5561 | 2.6813 |
| 0.1794 | 0.5199 | 2.6813 |
| 0.2392 | 0.4759 | 2.6813 |
| 0.3002 | 0.4228 | 2.6813 |
| 0.3625 | 0.3588 | 2.6813 |
| 0.4264 | 0.2821 | 2.6813 |
| 0.4921 | 0.1902 | 2.6813 |
| 0.5594 | 0.0805 | 2.6813 |
| 0.6279 | −0.0490 | 2.6813 |
| 0.6974 | −0.1996 | 2.6813 |
| 0.7686 | −0.3726 | 2.6813 |
| 0.8430 | −0.5681 | 2.6813 |
| 0.9224 | −0.7863 | 2.6813 |
| 1.0081 | −1.0288 | 2.6813 |
| 1.0119 | −1.0399 | 2.6813 |
| 1.0152 | −1.0511 | 2.6813 |

TABLE 1-continued

| X | Y | Z |
|---|---|---|
| 1.0176 | −1.0621 | 2.6813 |
| 1.0188 | −1.0727 | 2.6813 |
| 1.0186 | −1.0827 | 2.6813 |
| 1.0171 | −1.0923 | 2.6813 |
| 1.0140 | −1.1016 | 2.6813 |
| 1.0093 | −1.1105 | 2.6813 |
| 1.0031 | −1.1188 | 2.6813 |
| 0.9955 | −1.1262 | 2.6813 |
| 0.9869 | −1.1323 | 2.6813 |
| 0.9776 | −1.1370 | 2.6813 |
| 0.9678 | −1.1405 | 2.6813 |
| 0.9575 | −1.1425 | 2.6813 |
| 0.9470 | −1.1430 | 2.6813 |
| 0.9367 | −1.1418 | 2.6813 |
| 0.9269 | −1.1391 | 2.6813 |
| 0.9180 | −1.1348 | 2.6813 |
| 0.9099 | −1.1293 | 2.6813 |
| 0.9024 | −1.1226 | 2.8813 |
| 0.8955 | −1.1146 | 2.6813 |
| 0.8892 | −1.1055 | 2.6813 |
| 0.8833 | −1.0958 | 2.6813 |
| 0.8778 | −1.0859 | 2.6813 |
| 0.8583 | −1.1038 | 2.9250 |
| 0.7565 | −0.9201 | 2.9250 |
| 0.6621 | −0.7583 | 2.9250 |
| 0.5738 | −0.6167 | 2.9250 |
| 0.4904 | −0.4941 | 2.9250 |
| 0.4109 | −0.3896 | 2.9250 |
| 0.3352 | −0.3022 | 2.9250 |
| 0.2634 | −0.2303 | 2.9250 |
| 0.1954 | −0.1719 | 2.9250 |
| 0.1307 | −0.1248 | 2.9250 |
| 0.0685 | −0.0872 | 2.9250 |
| 0.0082 | −0.0575 | 2.9250 |
| 0.0508 | −0.0348 | 2.9250 |
| −0.1081 | −0.0187 | 2.9250 |
| −0.1628 | −0.0087 | 2.9250 |
| −0.2152 | −0.0040 | 2.9250 |
| −0.2664 | −0.0041 | 2.9250 |
| −0.3172 | −0.0088 | 2.9250 |
| −0.3685 | −0.0182 | 2.9250 |
| −0.4205 | −0.0325 | 2.9250 |
| −0.4714 | −0.0512 | 2.9250 |
| −0.5204 | −0.0733 | 2.9250 |
| −0.5674 | −0.0978 | 2.9250 |
| −0.6128 | −0.1240 | 2.9250 |
| −0.6574 | −0.1515 | 2.9250 |
| −0.7019 | −0.1801 | 2.9250 |
| −0.7127 | −0.1872 | 2.9250 |
| −0.7233 | −0.1941 | 2.9250 |
| −0.7340 | −0.2011 | 2.9250 |
| −0.7450 | −0.2082 | 2.9250 |
| −0.7567 | −0.2153 | 2.9250 |
| −0.7689 | −0.2223 | 2.9250 |
| −0.7815 | −0.2288 | 2.9250 |
| −0.7945 | −0.2344 | 2.9250 |
| −0.8078 | −0.2387 | 2.9250 |
| −0.8208 | −0.2411 | 2.9250 |
| −0.8329 | −0.2417 | 2.9250 |
| −0.8441 | −0.2407 | 2.9250 |
| −0.8547 | −0.2380 | 2.9250 |
| −0.8649 | −0.2338 | 2.9250 |
| −0.8745 | −0.2278 | 2.9250 |
| −0.8832 | −0.2204 | 2.9250 |
| −0.8906 | −0.2118 | 2.9250 |
| −0.8966 | −0.2023 | 2.9250 |
| −0.9013 | −0.1917 | 2.9250 |
| −0.9049 | −0.1799 | 2.9250 |
| −0.9074 | −0.1670 | 2.9250 |
| −0.9086 | −0.1534 | 2.9250 |
| −0.9090 | −0.1396 | 2.9250 |
| −0.9086 | −0.1258 | 2.9250 |
| −0.9077 | −0.1120 | 2.9250 |
| −0.9064 | −0.0985 | 2.9250 |
| −0.9048 | −0.0855 | 2.9250 |
| −0.9031 | −0.0728 | 2.9250 |
| −0.9011 | −0.0602 | 2.9250 |

TABLE 1-continued

| X | Y | Z |
|---|---|---|
| −0.8990 | −0.0474 | 2.9250 |
| −0.8867 | 0.0106 | 2.9250 |
| −0.8708 | 0.0676 | 2.9250 |
| −0.8513 | 0.1235 | 2.9250 |
| −0.8284 | 0.1781 | 2.9250 |
| −0.8019 | 0.2317 | 2.9250 |
| −0.7713 | 0.2848 | 2.9250 |
| −0.7356 | 0.3379 | 2.9250 |
| −0.6940 | 0.3909 | 2.9250 |
| −0.6467 | 0.4418 | 2.9250 |
| −0.5958 | 0.4877 | 2.9250 |
| −0.5437 | 0.5269 | 2.9250 |
| −0.4914 | 0.5592 | 2.9250 |
| −0.4391 | 0.5852 | 2.9250 |
| −0.3865 | 0.6056 | 2.9250 |
| −0.3334 | 0.6207 | 2.9250 |
| −0.2793 | 0.6306 | 2.9250 |
| −0.2248 | 0.6353 | 2.9250 |
| −0.1702 | 0.6347 | 2.9250 |
| −0.1153 | 0.6289 | 2.9250 |
| −0.0598 | 0.6176 | 2.9250 |
| −0.0039 | 0.6006 | 2.9250 |
| 0.0524 | 0.5777 | 2.9250 |
| 0.1094 | 0.5483 | 2.9250 |
| 0.1675 | 0.5116 | 2.9250 |
| 0.2265 | 0.4669 | 2.9250 |
| 0.2867 | 0.4129 | 2.9250 |
| 0.3484 | 0.3479 | 2.9250 |
| 0.4118 | 0.2698 | 2.9250 |
| 0.4770 | 0.1764 | 2.9250 |
| 0.5436 | 0.0653 | 2.9250 |
| 0.6114 | −0.0654 | 2.9250 |
| 0.6802 | −0.2170 | 2.9250 |
| 0.7508 | −0.3906 | 2.9250 |
| 0.8246 | −0.5865 | 2.9250 |
| 0.9035 | −0.8047 | 2.9250 |
| 0.9888 | −1.0473 | 2.9250 |
| 0.9925 | −1.0583 | 2.9250 |
| 0.9959 | −1.0695 | 2.9250 |
| 0.9983 | −1.0806 | 2.9250 |
| 0.9994 | −1.0912 | 2.9250 |
| 0.9992 | −1.1012 | 2.9250 |
| 0.9976 | −1.1107 | 2.9250 |
| 0.9945 | −1.1200 | 2.9250 |
| 0.9898 | −1.1290 | 2.9250 |
| 0.9836 | −1.1373 | 2.9250 |
| 0.9759 | −1.1446 | 2.9250 |
| 0.9673 | −1.1506 | 2.9250 |
| 0.9580 | −1.1554 | 2.9250 |
| 0.9481 | −1.1588 | 2.9250 |
| 0.9378 | −1.1608 | 2.9250 |
| 0.9273 | −1.1613 | 2.9250 |
| 0.9169 | −1.1600 | 2.9250 |
| 0.9072 | −1.1572 | 2.9250 |
| 0.8983 | −1.1530 | 2.9250 |
| 0.8902 | −1.1475 | 2.9250 |
| 0.8828 | −1.1407 | 2.9250 |
| 0.8759 | −1.1326 | 2.9250 |
| 0.8696 | −1.1235 | 2.9250 |
| 0.8638 | −1.1138 | 2.9250 |
| 0.8583 | −1.1038 | 2.9250 |
| 0.8388 | −1.1218 | 3.1688 |
| 0.7373 | −0.9357 | 3.1688 |
| 0.6433 | −0.7713 | 3.1688 |
| 0.5556 | −0.6269 | 3.1688 |
| 0.4729 | −0.5014 | 3.1688 |
| 0.3941 | −0.3939 | 3.1688 |
| 0.3191 | −0.3036 | 3.1688 |
| 0.2478 | −0.2291 | 3.1688 |
| 0.1799 | −0.1682 | 3.1688 |
| 0.1150 | −0.1188 | 3.1688 |
| 0.0537 | −0.0799 | 3.1688 |
| −0.0034 | −0.0503 | 3.1688 |
| −0.0570 | −0.0281 | 3.1688 |
| −0.1080 | −0.0120 | 3.1688 |
| −0.1578 | −0.0008 | 3.1688 |
| −0.2078 | 0.0059 | 3.1688 |

TABLE 1-continued

| X | Y | Z |
|---|---|---|
| −0.2576 | 0.0080 | 3.1688 |
| −0.3075 | 0.0055 | 3.1688 |
| −0.3583 | −0.0018 | 3.1688 |
| −0.4101 | −0.0141 | 3.1688 |
| −0.4609 | −0.0310 | 3.1688 |
| −0.5098 | −0.0515 | 3.1688 |
| −0.5570 | −0.0749 | 3.1688 |
| −0.6028 | −0.1004 | 3.1688 |
| −0.6477 | −0.1274 | 3.1688 |
| −0.6922 | −0.1554 | 3.1688 |
| −0.7028 | −0.1622 | 3.1688 |
| −0.7131 | −0.1689 | 3.1688 |
| −0.7236 | −0.1757 | 3.1688 |
| −0.7345 | −0.1825 | 3.1688 |
| −0.7459 | −0.1893 | 3.1688 |
| −0.7578 | −0.1960 | 3.1688 |
| −0.7701 | −0.2021 | 3.1688 |
| −0.7827 | −0.2073 | 3.1688 |
| −0.7955 | −0.2112 | 3.1688 |
| −0.8081 | −0.2134 | 3.1688 |
| −0.8199 | −0.2138 | 3.1688 |
| −0.8307 | −0.2126 | 3.1688 |
| −0.8410 | −0.2099 | 3.1688 |
| −0.8509 | −0.2056 | 3.1688 |
| −0.8602 | −0.1998 | 3.1688 |
| −0.8685 | −0.1925 | 3.1688 |
| −0.8756 | −0.1840 | 3.1688 |
| −0.8814 | −0.1747 | 3.1688 |
| −0.8859 | −0.1644 | 3.1688 |
| −0.8893 | −0.1530 | 3.1688 |
| −0.8916 | −0.1406 | 3.1688 |
| −0.8928 | −0.1275 | 3.1688 |
| −0.8931 | −0.1142 | 3.1688 |
| −0.8927 | −0.1008 | 3.1688 |
| −0.8918 | −0.0875 | 3.1688 |
| −0.8906 | −0.0744 | 3.1688 |
| −0.8890 | −0.0617 | 3.1688 |
| −0.8873 | −0.0493 | 3.1688 |
| −0.8854 | −0.0370 | 3.1688 |
| −0.8832 | −0.0245 | 3.1688 |
| −0.8710 | 0.0324 | 3.1688 |
| −0.8549 | 0.0883 | 3.1688 |
| −0.8354 | 0.1432 | 3.1688 |
| −0.8124 | 0.1966 | 3.1688 |
| −0.7858 | 0.2490 | 3.1688 |
| −0.7551 | 0.3007 | 3.1688 |
| −0.7194 | 0.3523 | 3.1688 |
| −0.6777 | 0.4037 | 3.1688 |
| −0.6306 | 0.4528 | 3.1688 |
| −0.5802 | 0.4969 | 3.1688 |
| −0.5292 | 0.5338 | 3.1688 |
| −0.4786 | 0.5639 | 3.1688 |
| −0.4284 | 0.5879 | 3.1688 |
| −0.3786 | 0.6064 | 3.1688 |
| −0.3284 | 0.6199 | 3.1688 |
| −0.2777 | 0.6287 | 3.1688 |
| −0.2266 | 0.6326 | 3.1688 |
| −0.1749 | 0.6317 | 3.1688 |
| −0.1227 | 0.6258 | 3.1688 |
| −0.0696 | 0.6146 | 3.1688 |
| −0.0156 | 0.5978 | 3.1688 |
| 0.0390 | 0.5750 | 3.1688 |
| 0.0945 | 0.5458 | 3.1688 |
| 0.1512 | 0.5091 | 3.1688 |
| 0.2094 | 0.4640 | 3.1688 |
| 0.2688 | 0.4094 | 3.1688 |
| 0.3301 | 0.3433 | 3.1688 |
| 0.3932 | 0.2638 | 3.1688 |
| 0.4580 | 0.1687 | 3.1688 |
| 0.5242 | 0.0559 | 3.1688 |
| 0.5916 | −0.0763 | 3.1688 |
| 0.6601 | 0.2293 | 3.1688 |
| 0.7307 | −0.4042 | 3.1688 |
| 0.8047 | −0.6014 | 3.1688 |
| 0.8839 | −0.8211 | 3.1688 |
| 0.9695 | −1.0656 | 3.1688 |
| 0.9732 | −1.0767 | 3.1688 |

TABLE 1-continued

| X | Y | Z |
|---|---|---|
| 0.9765 | −1.0878 | 3.1688 |
| 0.9789 | −1.0989 | 3.1688 |
| 0.9800 | −1.1095 | 3.1688 |
| 0.9798 | −1.1195 | 3.1688 |
| 0.9782 | −1.1291 | 3.1688 |
| 0.9750 | −1.1384 | 3.1688 |
| 0.9703 | −1.1473 | 3.1688 |
| 0.9640 | −1.1556 | 3.1688 |
| 0.9564 | −1.1629 | 3.1688 |
| 0.9477 | −1.1690 | 3.1688 |
| 0.9384 | −1.1738 | 3.1688 |
| 0.9285 | −1.1772 | 3.1688 |
| 0.9181 | −1.1791 | 3.1688 |
| 0.9076 | −1.1796 | 3.1688 |
| 0.8972 | −1.1783 | 3.1688 |
| 0.8875 | −1.1755 | 3.1688 |
| 0.8786 | −1.1712 | 3.1688 |
| 0.8706 | −1.1657 | 3.1688 |
| 0.8632 | −1.1588 | 3.1688 |
| 0.8563 | −1.1508 | 3.1688 |
| 0.8501 | −1.1416 | 3.1688 |
| 0.8443 | −1.1318 | 3.1688 |
| 0.8388 | −1.1218 | 3.1688 |
| 0.8194 | −1.1400 | 3.4125 |
| 0.7191 | −0.9533 | 3.4125 |
| 0.6264 | −0.7877 | 3.4125 |
| 0.5402 | −0.6413 | 3.4125 |
| 0.4590 | −0.5133 | 3.4125 |
| 0.3816 | −0.4030 | 3.4125 |
| 0.3078 | −0.3096 | 3.4125 |
| 0.2373 | −0.2318 | 3.4125 |
| 0.1703 | −0.1680 | 3.4125 |
| 0.1065 | −0.1164 | 3.4125 |
| 0.0466 | −0.0758 | 3.4125 |
| −0.0089 | −0.0448 | 3.4125 |
| −0.0608 | −0.0213 | 3.4125 |
| −0.1103 | −0.0038 | 3.4125 |
| −0.1587 | 0.0087 | 3.4125 |
| −0.2073 | 0.0168 | 3.4125 |
| −0.2559 | 0.0203 | 3.4125 |
| −0.3049 | 0.0193 | 3.4125 |
| −0.3548 | 0.0136 | 3.4125 |
| −0.4053 | 0.0029 | 3.4125 |
| −0.4546 | −0.0122 | 3.4125 |
| −0.5022 | −0.0310 | 3.4125 |
| −0.5486 | −0.0530 | 3.4125 |
| −0.5941 | −0.0774 | 3.4125 |
| −0.6386 | −0.1035 | 3.4125 |
| −0.6824 | −0.1306 | 3.4125 |
| −0.6929 | −0.1373 | 3.4125 |
| −0.7032 | −0.1438 | 3.4125 |
| −0.7136 | −0.1503 | 3.4125 |
| −0.7243 | −0.1569 | 3.4125 |
| −0.7358 | −0.1636 | 3.4125 |
| −0.7478 | −0.1700 | 3.4125 |
| −0.7607 | −0.1760 | 3.4125 |
| −0.7743 | −0.1810 | 3.4125 |
| −0.7883 | −0.1843 | 3.4125 |
| −0.8019 | −0.1855 | 3.4125 |
| −0.8143 | −0.1846 | 3.4125 |
| −0.8256 | −0.1819 | 3.4125 |
| −0.8357 | −0.1777 | 3.4125 |
| −0.8448 | −0.1721 | 3.4125 |
| −0.8530 | −0.1651 | 3.4125 |
| −0.8601 | −0.1569 | 3.4125 |
| −0.8657 | −0.1479 | 3.4125 |
| −0.8702 | −0.1380 | 3.4125 |
| −0.8735 | 0.1270 | 3.4125 |
| −0.8758 | −0.1150 | 3.4125 |
| −0.8770 | −0.1024 | 3.4125 |
| −0.8773 | −0.0895 | 3.4125 |
| −0.8769 | −0.0764 | 3.4125 |
| −0.8761 | −0.0634 | 3.4125 |
| −0.8748 | −0.0506 | 3.4125 |
| −0.8733 | −0.0382 | 3.4125 |
| −0.8716 | −0.0260 | 3.4125 |
| −0.8696 | −0.0139 | 3.4125 |

TABLE 1-continued

| X | Y | Z |
|---|---|---|
| −0.8675 | −0.0017 | 3.4125 |
| −0.8518 | 0.0672 | 3.4125 |
| −0.8296 | 0.1365 | 3.4125 |
| −0.8013 | 0.2046 | 3.4125 |
| −0.7673 | 0.2701 | 3.4125 |
| −0.7283 | 0.3319 | 3.4125 |
| −0.6854 | 0.3887 | 3.4125 |
| −0.6393 | 0.4397 | 3.4125 |
| −0.5909 | 0.4846 | 3.4125 |
| −0.5413 | 0.5230 | 3.4125 |
| −0.4910 | 0.5551 | 3.4125 |
| −0.4403 | 0.5813 | 3.4125 |
| −0.3897 | 0.6016 | 3.4125 |
| −0.3394 | 0.6165 | 3.4125 |
| −0.2893 | 0.6263 | 3.4125 |
| −0.2391 | 0.6311 | 3.4125 |
| −0.1884 | 0.6309 | 3.4125 |
| −0.1370 | 0.6258 | 3.4125 |
| −0.0850 | 0.6153 | 3.4125 |
| −0.0340 | 0.5998 | 3.4125 |
| 0.0151 | 0.5799 | 3.4125 |
| 0.0629 | 0.5557 | 3.4125 |
| 0.1106 | 0.5264 | 3.4125 |
| 0.1598 | 0.4907 | 3.4125 |
| 0.2118 | 0.4464 | 3.4125 |
| 0.2672 | 0.3913 | 3.4125 |
| 0.3259 | 0.3236 | 3.4125 |
| 0.3867 | 0.2420 | 3.4125 |
| 0.4491 | 0.1451 | 3.4125 |
| 0.5128 | 0.0312 | 3.4125 |
| 0.5780 | −0.1014 | 3.4125 |
| 0.6448 | −0.2541 | 3.4125 |
| 0.7140 | −0.4279 | 3.4125 |
| 0.7870 | −0.6233 | 3.4125 |
| 0.8654 | −0.8412 | 3.4125 |
| 0.9501 | −1.0840 | 3.4125 |
| 0.9538 | −1.0950 | 3.4125 |
| 0.9571 | −1.1061 | 3.4125 |
| 0.9594 | −1.1172 | 3.4125 |
| 0.9605 | −1.1279 | 3.4125 |
| 0.9603 | −1.1379 | 3.4125 |
| 0.9587 | −1.1474 | 3.4125 |
| 0.9556 | −1.1568 | 3.4125 |
| 0.9508 | −1.1657 | 3.4125 |
| 0.9445 | −1.1740 | 3.4125 |
| 0.9368 | −1.1813 | 3.4125 |
| 0.9282 | −1.1874 | 3.4125 |
| 0.9188 | −1.1922 | 3.4125 |
| 0.9088 | −1.1956 | 3.4125 |
| 0.8985 | −1.1976 | 3.4125 |
| 0.8879 | −1.1980 | 3.4125 |
| 0.8776 | −1.1967 | 3.4125 |
| 0.8679 | −1.1939 | 3.4125 |
| 0.8590 | −1.1896 | 3.4125 |
| 0.8510 | −1.1840 | 3.4125 |
| 0.8436 | −1.1771 | 3.4125 |
| 0.8368 | −1.1690 | 3.4125 |
| 0.8306 | −1.1598 | 3.4125 |
| 0.8248 | −1.1500 | 3.4125 |
| 0.8194 | −1.1400 | 3.4125 |
| 0.8000 | −1.1581 | 3.6563 |
| 0.7011 | −0.9713 | 3.6563 |
| 0.6100 | −0.8048 | 3.6563 |
| 0.5254 | −0.6567 | 3.6563 |
| 0.4459 | −0.5264 | 3.6563 |
| 0.3703 | −0.4133 | 3.6563 |
| 0.2980 | −0.3168 | 3.6563 |
| 0.2288 | −0.2358 | 3.6563 |
| 0.1628 | −0.1690 | 3.6563 |
| 0.1003 | −0.1148 | 3.6563 |
| 0.0418 | −0.0722 | 3.6563 |
| −0.0123 | −0.0393 | 3.6563 |
| −0.0629 | −0.0143 | 3.6563 |
| −0.1110 | 0.0046 | 3.6563 |
| −0.1581 | 0.0186 | 3.6563 |
| −0.2055 | 0.0281 | 3.6563 |
| −0.2530 | 0.0331 | 3.6563 |

TABLE 1-continued

| X | Y | Z |
|---|---|---|
| −0.3012 | 0.0337 | 3.6563 |
| −0.3502 | 0.0294 | 3.6563 |
| −0.3995 | 0.0204 | 3.6563 |
| −0.4475 | 0.0070 | 3.6563 |
| −0.4940 | −0.0102 | 3.6563 |
| −0.5398 | −0.0309 | 3.6563 |
| −0.5850 | −0.0543 | 3.6563 |
| −0.6293 | −0.0796 | 3.6563 |
| −0.6725 | −0.1058 | 3.6563 |
| −0.6827 | −0.1121 | 3.6563 |
| −0.6927 | −0.1183 | 3.6563 |
| −0.7027 | −0.1244 | 3.6563 |
| −0.7131 | −0.1306 | 3.6563 |
| −0.7241 | −0.1368 | 3.6563 |
| −0.7358 | −0.1428 | 3.6563 |
| −0.7482 | −0.1483 | 3.6563 |
| −0.7614 | −0.1529 | 3.6563 |
| −0.7751 | −0.1560 | 3.6563 |
| −0.7884 | −0.1570 | 3.6563 |
| −0.8006 | −0.1560 | 3.6563 |
| −0.8115 | −0.1534 | 3.6563 |
| −0.8213 | −0.1494 | 3.6563 |
| −0.8300 | −0.1441 | 3.6563 |
| −0.8378 | −0.1376 | 3.6563 |
| −0.8446 | −0.1299 | 3.6563 |
| −0.8501 | −0.1213 | 3.6563 |
| −0.8544 | −0.1121 | 3.6563 |
| −0.8576 | −0.1022 | 3.6563 |
| −0.8598 | −0.0914 | 3.6563 |
| −0.8612 | −0.0797 | 3.6563 |
| −0.8617 | −0.0667 | 3.6563 |
| −0.8614 | −0.0522 | 3.6563 |
| −0.8602 | −0.0362 | 3.6563 |
| −0.8582 | −0.0186 | 3.6563 |
| −0.8554 | 0.0005 | 3.6563 |
| −0.8518 | 0.0211 | 3.6563 |
| −0.8360 | 0.0883 | 3.6563 |
| −0.8138 | 0.1561 | 3.6563 |
| −0.7854 | 0.2227 | 3.6583 |
| −0.7512 | 0.2868 | 3.6563 |
| −0.7120 | 0.3472 | 3.6563 |
| −0.6688 | 0.4026 | 3.6563 |
| −0.6226 | 0.4522 | 3.6563 |
| −0.5741 | 0.4958 | 3.6563 |
| −0.5243 | 0.5329 | 3.6563 |
| −0.4738 | 0.5637 | 3.6563 |
| −0.4229 | 0.5884 | 3.6563 |
| −0.3722 | 0.6073 | 3.6563 |
| −0.3219 | 0.6204 | 3.6563 |
| −0.2719 | 0.6284 | 3.6563 |
| −0.2223 | 0.6312 | 3.6563 |
| −0.1726 | 0.6291 | 3.6563 |
| −0.1224 | 0.6218 | 3.6563 |
| −0.0716 | 0.6092 | 3.6563 |
| −0.0218 | 0.5915 | 3.6563 |
| 0.0261 | 0.5694 | 3.6563 |
| 0.0726 | 0.5428 | 3.6563 |
| 0.1189 | 0.5112 | 3.6563 |
| 0.1666 | 0.4730 | 3.6563 |
| 0.2168 | 0.4260 | 3.6563 |
| 0.2702 | 0.3682 | 3.6563 |
| 0.3263 | 0.2979 | 3.6563 |
| 0.3842 | 0.2141 | 3.6563 |
| 0.4436 | 0.1154 | 3.6563 |
| 0.5044 | 0.0004 | 3.6563 |
| 0.5668 | −0.1324 | 3.6563 |
| 0.6313 | −0.2842 | 3.6563 |
| 0.6987 | −0.4562 | 3.6563 |
| 0.7703 | −0.6489 | 3.6563 |
| 0.8474 | −0.8635 | 3.6563 |
| 0.9307 | −1.1022 | 3.6563 |
| 0.9344 | −1.1132 | 3.6563 |
| 0.9376 | −1.1244 | 3.6563 |
| 0.9400 | −1.1355 | 3.6563 |
| 0.9412 | −1.1461 | 3.6563 |
| 0.9409 | −1.1562 | 3.6563 |
| 0.9393 | −1.1657 | 3.6563 |

TABLE 1-continued

| X | Y | Z |
|---|---|---|
| 0.9362 | −1.1751 | 3.6563 |
| 0.9314 | −1.1840 | 3.6563 |
| 0.9251 | −1.1923 | 3.6563 |
| 0.9174 | −1.1997 | 3.6563 |
| 0.9087 | −1.2058 | 3.6563 |
| 0.8993 | −1.2106 | 3.6563 |
| 0.8893 | −1.2140 | 3.6563 |
| 0.8789 | −1.2160 | 3.6563 |
| 0.8683 | −1.2164 | 3.6563 |
| 0.8580 | −1.2151 | 3.6563 |
| 0.8483 | −1.2122 | 3.6563 |
| 0.8394 | −1.2079 | 3.6563 |
| 0.8314 | −1.2024 | 3.6563 |
| 0.8241 | −1.1955 | 3.6563 |
| 0.8173 | −1.1874 | 3.6563 |
| 0.8111 | −1.1781 | 3.6563 |
| 0.8054 | −1.1682 | 3.6563 |
| 0.8000 | −1.1581 | 3.6563 |
| 0.7806 | −1.1762 | 3.9000 |
| 0.6836 | −0.9901 | 3.9000 |
| 0.5945 | −0.8235 | 3.9000 |
| 0.5120 | −0.6745 | 3.9000 |
| 0.4347 | −0.5423 | 3.9000 |
| 0.3614 | −0.4269 | 3.9000 |
| 0.2912 | −0.3276 | 3.9000 |
| 0.2240 | −0.2436 | 3.9000 |
| 0.1598 | −0.1736 | 3.9000 |
| 0.0985 | −0.1162 | 3.9000 |
| 0.0411 | −0.0707 | 3.9000 |
| −0.0121 | −0.0354 | 3.9000 |
| −0.0616 | −0.0083 | 3.9000 |
| −0.1087 | 0.0124 | 3.9000 |
| −0.1548 | 0.0281 | 3.9000 |
| −0.2011 | 0.0393 | 3.9000 |
| −0.2479 | 0.0461 | 3.9000 |
| −0.2955 | 0.0483 | 3.9000 |
| −0.3438 | 0.0457 | 3.9000 |
| −0.3921 | 0.0383 | 3.9000 |
| −0.4391 | 0.0266 | 3.9000 |
| −0.4848 | 0.0109 | 3.9000 |
| −0.5303 | −0.0084 | 3.9000 |
| −0.5755 | −0.0310 | 3.9000 |
| −0.6198 | −0.0556 | 3.9000 |
| −0.6627 | −0.0809 | 3.9000 |
| −0.6728 | −0.0870 | 3.9000 |
| −0.6826 | −0.0930 | 3.9000 |
| −0.6926 | −0.0989 | 3.9000 |
| −0.7029 | −0.1048 | 3.9000 |
| −0.7138 | −0.1107 | 3.9000 |
| −0.7254 | −0.1164 | 3.9000 |
| −0.7377 | −0.1215 | 3.9000 |
| −0.7510 | −0.1256 | 3.9000 |
| −0.7647 | −0.1281 | 3.9000 |
| −0.7778 | −0.1285 | 3.9000 |
| −0.7896 | −0.1271 | 3.9000 |
| −0.8001 | −0.1241 | 3.9000 |
| −0.8094 | −0.1199 | 3.9000 |
| −0.8176 | −0.1144 | 3.9000 |
| −0.8250 | −0.1077 | 3.9000 |
| −0.8313 | −0.1000 | 3.9000 |
| −0.8364 | −0.0915 | 3.9000 |
| −0.8403 | −0.0823 | 3.9000 |
| −0.8433 | −0.0721 | 3.9000 |
| −0.8452 | −0.0611 | 3.9000 |
| −0.8463 | −0.0496 | 3.9000 |
| −0.8465 | −0.0377 | 3.9000 |
| −0.8460 | −0.0257 | 3.9000 |
| −0.8450 | −0.0136 | 3.9000 |
| −0.8437 | −0.0017 | 3.9000 |
| −0.8421 | 0.0099 | 3.9000 |
| −0.8403 | 0.0213 | 3.9000 |
| −0.8383 | 0.0326 | 3.9000 |
| −0.8361 | 0.0439 | 3.9000 |
| −0.8202 | 0.1089 | 3.9000 |
| −0.7976 | 0.1758 | 3.9000 |
| −0.7686 | 0.2419 | 3.9000 |
| −0.7340 | 0.3051 | 3.9000 |

TABLE 1-continued

| X | Y | Z |
|---|---|---|
| −0.6950 | 0.3636 | 3.9000 |
| −0.6535 | 0.4156 | 3.9000 |
| −0.6110 | 0.4606 | 3.9000 |
| −0.5677 | 0.4993 | 3.9000 |
| −0.5241 | 0.5324 | 3.9000 |
| −0.4797 | 0.5604 | 3.9000 |
| −0.4340 | 0.5840 | 3.9000 |
| −0.3864 | 0.6032 | 3.9000 |
| −0.3374 | 0.6177 | 3.9000 |
| −0.2887 | 0.6269 | 3.9000 |
| −0.2407 | 0.6310 | 3.9000 |
| −0.1929 | 0.6303 | 3.9000 |
| −0.1448 | 0.6247 | 3.9000 |
| −0.0959 | 0.6139 | 3.9000 |
| −0.0468 | 0.5977 | 3.9000 |
| 0.0008 | 0.5769 | 3.9000 |
| 0.0465 | 0.5518 | 3.9000 |
| 0.0909 | 0.5224 | 3.9000 |
| 0.1353 | 0.4878 | 3.9000 |
| 0.1811 | 0.4463 | 3.9000 |
| 0.2293 | 0.3960 | 3.9000 |
| 0.2802 | 0.3346 | 3.9000 |
| 0.3334 | 0.2612 | 3.9000 |
| 0.3880 | 0.1748 | 3.9000 |
| 0.4438 | 0.0744 | 3.9000 |
| 0.5012 | −0.0415 | 3.9000 |
| 0.5603 | −0.1741 | 3.9000 |
| 0.6219 | −0.3244 | 3.9000 |
| 0.6866 | −0.4934 | 3.9000 |
| 0.7557 | −0.6815 | 3.9000 |
| 0.8304 | −0.8900 | 3.9000 |
| 0.9112 | −1.1205 | 3.9000 |
| 0.9149 | −1.1314 | 3.9000 |
| 0.9182 | −1.1426 | 3.9000 |
| 0.9207 | −1.1537 | 3.9000 |
| 0.9218 | −1.1644 | 3.9000 |
| 0.9216 | −1.1744 | 3.9000 |
| 0.9200 | −1.1840 | 3.9000 |
| 0.9169 | −1.1933 | 3.9000 |
| 0.9121 | −1.2022 | 3.9000 |
| 0.9058 | −1.2106 | 3.9000 |
| 0.8980 | −1.2179 | 3.9000 |
| 0.8893 | −1.2240 | 3.9000 |
| 0.8799 | −1.2289 | 3.9000 |
| 0.8698 | −1.2323 | 3.9000 |
| 0.8594 | −1.2343 | 3.9000 |
| 0.8487 | −1.2347 | 3.9000 |
| 0.8384 | −1.2334 | 3.9000 |
| 0.8287 | −1.2306 | 3.9000 |
| 0.8198 | −1.2263 | 3.9000 |
| 0.8118 | −1.2207 | 3.9000 |
| 0.8045 | −1.2138 | 3.9000 |
| 0.7978 | −1.2056 | 3.9000 |
| 0.7916 | −1.1963 | 3.9000 |
| 0.7859 | −1.1864 | 3.9000 |
| 0.7806 | −1.1762 | 3.9000 |
| 0.7612 | −1.1943 | 4.1438 |
| 0.6666 | −1.0096 | 4.1438 |
| 0.5797 | −0.8435 | 4.1438 |
| 0.4996 | −0.6942 | 4.1438 |
| 0.4250 | −0.5609 | 4.1438 |
| 0.3544 | −0.4436 | 4.1438 |
| 0.2869 | −0.3420 | 4.1438 |
| 0.2223 | −0.2552 | 4.1438 |
| 0.1604 | −0.1821 | 4.1438 |
| 0.1012 | −0.1216 | 4.1438 |
| 0.0453 | −0.0728 | 4.1438 |
| −0.0066 | −0.0345 | 4.1438 |
| −0.0553 | −0.0046 | 4.1438 |
| −0.1016 | 0.0186 | 4.1438 |
| −0.1471 | 0.0365 | 4.1438 |
| −0.1927 | 0.0499 | 4.1438 |
| −0.2391 | 0.0587 | 4.1438 |
| −0.2863 | 0.0629 | 4.1438 |
| −0.3343 | 0.0623 | 4.1438 |
| −0.3821 | 0.0587 | 4.1438 |
| −0.4286 | 0.0468 | 4.1438 |

TABLE 1-continued

| X | Y | Z |
|---|---|---|
| −0.4740 | 0.0327 | 4.1438 |
| −0.5195 | 0.0145 | 4.1438 |
| −0.5651 | −0.0072 | 4.1438 |
| −0.6098 | −0.0313 | 4.1438 |
| −0.6529 | −0.0561 | 4.1438 |
| −0.6628 | −0.0620 | 4.1438 |
| −0.6726 | −0.0677 | 4.1438 |
| −0.6825 | −0.0734 | 4.1438 |
| −0.6927 | −0.0791 | 4.1438 |
| −0.7035 | −0.0846 | 4.1438 |
| −0.7150 | −0.0899 | 4.1438 |
| −0.7273 | −0.0946 | 4.1438 |
| −0.7404 | −0.0982 | 4.1438 |
| −0.7540 | −0.1002 | 4.1438 |
| −0.7670 | −0.1001 | 4.1438 |
| −0.7787 | −0.0982 | 4.1438 |
| −0.7891 | −0.0947 | 4.1438 |
| −0.7984 | −0.0898 | 4.1438 |
| −0.8067 | −0.0836 | 4.1438 |
| −0.8141 | −0.0759 | 4.1438 |
| −0.8204 | −0.0665 | 4.1438 |
| −0.8253 | −0.0558 | 4.1438 |
| −0.8289 | −0.0435 | 4.1438 |
| −0.8310 | −0.0296 | 4.1438 |
| −0.8316 | −0.0139 | 4.1438 |
| −0.8307 | 0.0035 | 4.1438 |
| −0.8284 | 0.0228 | 4.1438 |
| −0.8250 | 0.0438 | 4.1438 |
| −0.8204 | 0.0687 | 4.1438 |
| −0.8035 | 0.1314 | 4.1438 |
| −0.7804 | 0.1970 | 4.1438 |
| −0.7515 | 0.2610 | 4.1438 |
| −0.7174 | 0.3220 | 4.1438 |
| −0.6793 | 0.3782 | 4.1438 |
| −0.6390 | 0.4281 | 4.1438 |
| −0.5975 | 0.4714 | 4.1438 |
| −0.5555 | 0.5086 | 4.1438 |
| −0.5130 | 0.5402 | 4.1438 |
| −0.4702 | 0.5668 | 4.1438 |
| −0.4264 | 0.5888 | 4.1438 |
| −0.3813 | 0.6066 | 4.1438 |
| −0.3351 | 0.6198 | 4.1438 |
| −0.2889 | 0.6282 | 4.1438 |
| −0.2431 | 0.6318 | 4.1438 |
| −0.1977 | 0.6308 | 4.1438 |
| −0.1520 | 0.6253 | 4.1438 |
| −0.1056 | 0.6148 | 4.1438 |
| −0.0585 | 0.5992 | 4.1438 |
| −0.0120 | 0.5787 | 4.1438 |
| 0.0324 | 0.5540 | 4.1438 |
| 0.0750 | 0.5255 | 4.1438 |
| 0.1166 | 0.4928 | 4.1438 |
| 0.1586 | 0.4547 | 4.1438 |
| 0.2022 | 0.4094 | 4.1438 |
| 0.2481 | 0.3549 | 4.1438 |
| 0.2962 | 0.2896 | 4.1438 |
| 0.3460 | 0.2129 | 4.1438 |
| 0.3968 | 0.1242 | 4.1438 |
| 0.4488 | 0.0222 | 4.1438 |
| 0.5024 | −0.0940 | 4.1438 |
| 0.5579 | −0.2256 | 4.1438 |
| 0.6160 | −0.3735 | 4.1438 |
| 0.6774 | −0.5381 | 4.1438 |
| 0.7433 | −0.7198 | 4.1438 |
| 0.8146 | −0.9195 | 4.1438 |
| 0.8917 | −1.1387 | 4.1438 |
| 0.8955 | −1.1497 | 4.1438 |
| 0.8988 | −1.1609 | 4.1438 |
| 0.9013 | −1.1720 | 4.1438 |
| 0.9025 | −1.1826 | 4.1438 |
| 0.9023 | −1.1926 | 4.1438 |
| 0.9007 | −1.2022 | 4.1438 |
| 0.8976 | −1.2115 | 4.1438 |
| 0.8928 | −1.2205 | 4.1438 |
| 0.8864 | −1.2288 | 4.1438 |
| 0.8787 | −1.2362 | 4.1438 |
| 0.8699 | −1.2423 | 4.1438 |

TABLE 1-continued

| X | Y | Z |
|---|---|---|
| 0.8604 | −1.2471 | 4.1438 |
| 0.8504 | −1.2506 | 4.1438 |
| 0.8399 | −1.2526 | 4.1438 |
| 0.8292 | −1.2530 | 4.1438 |
| 0.8188 | −1.2518 | 4.1438 |
| 0.8091 | −1.2489 | 4.1438 |
| 0.8002 | −1.2446 | 4.1438 |
| 0.7923 | −1.2390 | 4.1438 |
| 0.7850 | −1.2321 | 4.1438 |
| 0.7782 | −1.2239 | 4.1438 |
| 0.7720 | −1.2145 | 4.1438 |
| 0.7664 | −1.2045 | 4.1438 |
| 0.7612 | −1.1943 | 4.1438 |
| 0.7417 | −1.2123 | 4.3875 |
| 0.6520 | −1.0336 | 4.3875 |
| 0.5701 | −0.8729 | 4.3875 |
| 0.4947 | −0.7277 | 4.3875 |
| 0.4247 | −0.5968 | 4.3875 |
| 0.3587 | −0.4801 | 4.3875 |
| 0.2959 | −0.3773 | 4.3875 |
| 0.2357 | −0.2881 | 4.3875 |
| 0.1778 | −0.2115 | 4.3875 |
| 0.1221 | −0.1466 | 4.3875 |
| 0.0689 | −0.0928 | 4.3875 |
| 0.0188 | −0.0493 | 4.3875 |
| 0.0282 | −0.0146 | 4.3875 |
| −0.0729 | 0.0130 | 4.3875 |
| −0.1161 | 0.0349 | 4.3875 |
| −0.1591 | 0.0523 | 4.3875 |
| −0.2026 | 0.0653 | 4.3875 |
| −0.2470 | 0.0741 | 4.3875 |
| −0.2921 | 0.0785 | 4.3875 |
| −0.3376 | 0.0783 | 4.3875 |
| −0.3827 | 0.0736 | 4.3875 |
| −0.4266 | 0.0648 | 4.3875 |
| −0.4699 | 0.0521 | 4.3875 |
| −0.5139 | 0.0353 | 4.3875 |
| −0.5582 | 0.0149 | 4.3875 |
| −0.6015 | −0.0079 | 4.3875 |
| −0.6431 | −0.0314 | 4.3875 |
| −0.6531 | −0.0372 | 4.3875 |
| −0.6630 | −0.0428 | 4.3875 |
| −0.6730 | −0.0485 | 4.3875 |
| −0.6834 | −0.0540 | 4.3875 |
| −0.6944 | −0.0594 | 4.3875 |
| −0.7062 | −0.0643 | 4.3875 |
| −0.7189 | −0.0686 | 4.3875 |
| −0.7324 | −0.0714 | 4.3875 |
| −0.7461 | −0.0724 | 4.3875 |
| −0.7588 | −0.0713 | 4.3875 |
| −0.7702 | −0.0685 | 4.3875 |
| −0.7803 | −0.0641 | 4.3875 |
| −0.7890 | −0.0584 | 4.3875 |
| −0.7968 | −0.0513 | 4.3875 |
| −0.8036 | −0.0426 | 4.3875 |
| −0.8092 | −0.0322 | 4.3875 |
| −0.8134 | −0.0201 | 4.3875 |
| −0.8159 | −0.0066 | 4.3875 |
| −0.8168 | 0.0072 | 4.3875 |
| −0.8165 | 0.0205 | 4.3875 |
| −0.8153 | 0.0330 | 4.3875 |
| −0.8137 | 0.0449 | 4.3875 |
| −0.8117 | 0.0563 | 4.3875 |
| −0.8096 | 0.0674 | 4.3875 |
| −0.8072 | 0.0784 | 4.3875 |
| −0.8047 | 0.0894 | 4.3875 |
| −0.7858 | 0.1564 | 4.3875 |
| −0.7610 | 0.2228 | 4.3875 |
| −0.7307 | 0.2868 | 4.3875 |
| −0.6956 | 0.3469 | 4.3875 |
| −0.6570 | 0.4016 | 4.3875 |
| −0.6164 | 0.4498 | 4.3875 |
| −0.5749 | 0.4912 | 4.3875 |
| −0.5328 | 0.5265 | 4.3875 |
| −0.4904 | 0.5561 | 4.3875 |
| −0.4478 | 0.5805 | 4.3875 |
| −0.4045 | 0.6003 | 4.3875 |

TABLE 1-continued

| X | Y | Z |
|---|---|---|
| −0.3603 | 0.6156 | 4.3875 |
| −0.3155 | 0.6262 | 4.3875 |
| −0.2707 | 0.6321 | 4.3875 |
| −0.2262 | 0.6334 | 4.3875 |
| −0.1818 | 0.6301 | 4.3875 |
| −0.1372 | 0.6223 | 4.3875 |
| −0.0916 | 0.6094 | 4.3875 |
| −0.0450 | 0.5910 | 4.3875 |
| 0.0007 | 0.5677 | 4.3875 |
| 0.0441 | 0.5404 | 4.3875 |
| 0.0854 | 0.5095 | 4.3875 |
| 0.1255 | 0.4747 | 4.3875 |
| 0.1660 | 0.4344 | 4.3875 |
| 0.2078 | 0.3869 | 4.3875 |
| 0.2518 | 0.3302 | 4.3875 |
| 0.2979 | 0.2628 | 4.3875 |
| 0.3453 | 0.1843 | 4.3875 |
| 0.3937 | 0.0941 | 4.3875 |
| 0.4433 | −0.0089 | 4.3875 |
| 0.4945 | −0.1257 | 4.3875 |
| 0.5478 | −0.2573 | 4.3875 |
| 0.6039 | −0.4044 | 4.3875 |
| 0.6635 | −0.5675 | 4.3875 |
| 0.7277 | −0.7468 | 4.3875 |
| 0.7971 | −0.9430 | 4.3875 |
| 0.8724 | −1.1572 | 4.3875 |
| 0.8761 | −1.1681 | 4.3875 |
| 0.8795 | −1.1793 | 4.3875 |
| 0.8819 | −1.1904 | 4.3875 |
| 0.8831 | −1.2011 | 4.3875 |
| 0.8829 | −1.2111 | 4.3875 |
| 0.8813 | −1.2206 | 4.3875 |
| 0.8781 | −1.2300 | 4.3875 |
| 0.8733 | −1.2389 | 4.3875 |
| 0.8670 | −1.2473 | 4.3875 |
| 0.8592 | −1.2546 | 4.3875 |
| 0.8504 | −1.2607 | 4.3875 |
| 0.8409 | −1.2655 | 4.3875 |
| 0.8308 | −1.2690 | 4.3875 |
| 0.8203 | −1.2710 | 4.3875 |
| 0.8096 | −1.2714 | 4.3875 |
| 0.7991 | −1.2701 | 4.3875 |
| 0.7894 | −1.2672 | 4.3875 |
| 0.7806 | −1.2629 | 4.3875 |
| 0.7726 | −1.2572 | 4.3875 |
| 0.7653 | −1.2503 | 4.3875 |
| 0.7586 | −1.2421 | 4.3875 |
| 0.7525 | −1.2326 | 4.3875 |
| 0.7469 | −1.2226 | 4.3875 |
| 0.7417 | −1.2123 | 4.3875 |
| 0.7222 | −1.2303 | 4.6313 |
| 0.6318 | −1.0458 | 4.6313 |
| 0.5505 | −0.8823 | 4.6313 |
| 0.4769 | −0.7364 | 4.6313 |
| 0.4093 | −0.6055 | 4.6313 |
| 0.3461 | −0.4886 | 4.6313 |
| 0.2861 | −0.3850 | 4.6313 |
| 0.2287 | −0.2944 | 4.6313 |
| 0.1734 | −0.2161 | 4.6313 |
| 0.1201 | −0.1491 | 4.6313 |
| 0.0690 | −0.0931 | 4.6313 |
| 0.0207 | −0.0473 | 4.6313 |
| −0.0250 | −0.0104 | 4.6313 |
| −0.0686 | 0.0192 | 4.6313 |
| −0.1109 | 0.0431 | 4.6313 |
| −0.1531 | 0.0623 | 4.6313 |
| −0.1959 | 0.0772 | 4.6313 |
| −0.2395 | 0.0877 | 4.6313 |
| −0.2838 | 0.0938 | 4.6313 |
| −0.3285 | 0.0953 | 4.6313 |
| −0.3729 | 0.0924 | 4.6313 |
| −0.4161 | 0.0852 | 4.6313 |
| −0.4592 | 0.0739 | 4.6313 |
| −0.5034 | 0.0584 | 4.6313 |
| −0.5480 | 0.0388 | 4.6313 |
| −0.5917 | 0.0165 | 4.6313 |
| −0.6333 | −0.0066 | 4.6313 |

TABLE 1-continued

| X | Y | Z |
|---|---|---|
| −0.6430 | −0.0122 | 4.6313 |
| −0.6526 | −0.0177 | 4.6313 |
| −0.6622 | −0.0231 | 4.6313 |
| −0.6723 | −0.0283 | 4.6313 |
| −0.6830 | −0.0334 | 4.6313 |
| −0.6944 | −0.0379 | 4.6313 |
| −0.7067 | −0.0417 | 4.6313 |
| −0.7200 | −0.0441 | 4.6313 |
| −0.7333 | −0.0447 | 4.6313 |
| −0.7458 | −0.0433 | 4.6313 |
| −0.7569 | −0.0403 | 4.6313 |
| −0.7667 | −0.0357 | 4.6313 |
| −0.7753 | −0.0300 | 4.6313 |
| −0.7828 | −0.0230 | 4.6313 |
| −0.7894 | −0.0144 | 4.6313 |
| −0.7949 | −0.0044 | 4.6313 |
| −0.7990 | 0.0074 | 4.6313 |
| −0.8014 | 0.0203 | 4.6313 |
| −0.8022 | 0.0335 | 4.6313 |
| −0.8017 | 0.0461 | 4.6313 |
| −0.8004 | 0.0581 | 4.6313 |
| −0.7986 | 0.0696 | 4.6313 |
| −0.7965 | 0.0805 | 4.6313 |
| −0.7942 | 0.0910 | 4.6313 |
| −0.7917 | 0.1015 | 4.6313 |
| −0.7890 | 0.1121 | 4.6313 |
| −0.7745 | 0.1619 | 4.6313 |
| −0.7571 | 0.2106 | 4.6313 |
| −0.7368 | 0.2582 | 4.6313 |
| −0.7137 | 0.3047 | 4.6313 |
| −0.6873 | 0.3500 | 4.6313 |
| −0.6576 | 0.3943 | 4.6313 |
| −0.6239 | 0.4374 | 4.6313 |
| −0.5859 | 0.4789 | 4.6313 |
| −0.5438 | 0.5176 | 4.6313 |
| −0.4994 | 0.5514 | 4.6313 |
| −0.4548 | 0.5790 | 4.6313 |
| −0.4113 | 0.6002 | 4.6313 |
| −0.3686 | 0.6160 | 4.6313 |
| −0.3256 | 0.6272 | 4.6313 |
| −0.2826 | 0.6338 | 4.6313 |
| −0.2398 | 0.6359 | 4.6313 |
| −0.1968 | 0.6336 | 4.6313 |
| −0.1537 | 0.6268 | 4.6313 |
| −0.1100 | 0.6152 | 4.6313 |
| −0.0657 | 0.5986 | 4.6313 |
| −0.0204 | 0.5763 | 4.6313 |
| 0.0263 | 0.5475 | 4.6313 |
| 0.0743 | 0.5113 | 4.6313 |
| 0.1233 | 0.4670 | 4.6313 |
| 0.1739 | 0.4127 | 4.6313 |
| 0.2261 | 0.3470 | 4.6313 |
| 0.2796 | 0.2682 | 4.6313 |
| 0.3341 | 0.1752 | 4.6313 |
| 0.3894 | 0.0672 | 4.6313 |
| 0.4457 | −0.0568 | 4.6313 |
| 0.5036 | −0.1977 | 4.6313 |
| 0.5642 | −0.3563 | 4.6313 |
| 0.6285 | −0.5329 | 4.6313 |
| 0.6974 | −0.7277 | 4.6313 |
| 0.7720 | −0.9414 | 4.6313 |
| 0.8531 | −1.1759 | 4.6313 |
| 0.8568 | −1.1868 | 4.6313 |
| 0.8601 | −1.1980 | 4.6313 |
| 0.8624 | −1.2091 | 4.6313 |
| 0.8635 | −1.2198 | 4.6313 |
| 0.8632 | −1.2298 | 4.6313 |
| 0.8616 | −1.2394 | 4.6313 |
| 0.8584 | −1.2488 | 4.6313 |
| 0.8535 | −1.2577 | 4.6313 |
| 0.8471 | −1.2660 | 4.6313 |
| 0.8394 | −1.2733 | 4.6313 |
| 0.8306 | −1.2794 | 4.6313 |
| 0.8211 | −1.2842 | 4.6313 |
| 0.8110 | −1.2875 | 4.6313 |
| 0.8005 | −1.2895 | 4.6313 |
| 0.7899 | −1.2898 | 4.6313 |

TABLE 1-continued

| X | Y | Z |
|---|---|---|
| 0.7794 | −1.2884 | 4.6313 |
| 0.7697 | −1.2855 | 4.6313 |
| 0.7609 | −1.2811 | 4.6313 |
| 0.7529 | −1.2755 | 4.6313 |
| 0.7457 | −1.2685 | 4.6313 |
| 0.7389 | −1.2602 | 4.6313 |
| 0.7329 | −1.2507 | 4.6313 |
| 0.7273 | −1.2406 | 4.6313 |
| 0.7222 | −1.2303 | 4.6313 |
| 0.7028 | −1.2484 | 4.8750 |
| 0.6130 | −1.0597 | 4.8750 |
| 0.5328 | −0.8940 | 4.8750 |
| 0.4608 | −0.7469 | 4.8750 |
| 0.3953 | −0.6156 | 4.8750 |
| 0.3345 | −0.4983 | 4.8750 |
| 0.2773 | −0.3938 | 4.8750 |
| 0.2225 | −0.3017 | 4.8750 |
| 0.1698 | −0.2214 | 4.8750 |
| 0.1189 | −0.1522 | 4.8750 |
| 0.0698 | −0.0938 | 4.8750 |
| 0.0231 | −0.0457 | 4.8750 |
| −0.0212 | −0.0065 | 4.8750 |
| −0.0636 | 0.0253 | 4.8750 |
| −0.1050 | 0.0512 | 4.8750 |
| −0.1465 | 0.0723 | 4.8750 |
| −0.1885 | 0.0890 | 4.8750 |
| −0.2314 | 0.1014 | 4.8750 |
| −0.2750 | 0.1092 | 4.8750 |
| −0.3189 | 0.1125 | 4.8750 |
| −0.3627 | 0.1112 | 4.8750 |
| −0.4055 | 0.1056 | 4.8750 |
| −0.4484 | 0.0959 | 4.8750 |
| −0.4928 | 0.0817 | 4.8750 |
| −0.5379 | 0.0630 | 4.8750 |
| −0.5820 | 0.0412 | 4.8750 |
| −0.6236 | 0.0180 | 4.8750 |
| −0.6423 | 0.0071 | 4.8750 |
| −0.6593 | −0.0022 | 4.8750 |
| −0.6751 | −0.0094 | 4.8750 |
| −0.6900 | −0.0143 | 4.8750 |
| −0.7040 | −0.0170 | 4.8750 |
| −0.7172 | −0.0175 | 4.8750 |
| −0.7293 | −0.0162 | 4.8750 |
| −0.7405 | −0.0133 | 4.8750 |
| −0.7507 | −0.0088 | 4.8750 |
| −0.7597 | −0.0030 | 4.8750 |
| −0.7675 | 0.0040 | 4.8750 |
| −0.7742 | 0.0123 | 4.8750 |
| −0.7798 | 0.0220 | 4.8750 |
| −0.7840 | 0.0333 | 4.8750 |
| −0.7866 | 0.0457 | 4.8750 |
| −0.7875 | 0.0585 | 4.8750 |
| −0.7870 | 0.0707 | 4.8750 |
| −0.7856 | 0.0824 | 4.8750 |
| −0.7837 | 0.0935 | 4.8750 |
| −0.7814 | 0.1041 | 4.8750 |
| −0.7789 | 0.1143 | 4.8750 |
| −0.7762 | 0.1245 | 4.8750 |
| −0.7733 | 0.1347 | 4.8750 |
| −0.7580 | 0.1834 | 4.8750 |
| −0.7401 | 0.2309 | 4.8750 |
| −0.7196 | 0.2775 | 4.8750 |
| −0.6962 | 0.3230 | 4.8750 |
| −0.6699 | 0.3674 | 4.8750 |
| −0.6403 | 0.4106 | 4.8750 |
| −0.6071 | 0.4525 | 4.8750 |
| −0.5698 | 0.4926 | 4.8750 |
| −0.5288 | 0.5297 | 4.8750 |
| −0.4855 | 0.5619 | 4.8750 |
| −0.4421 | 0.5879 | 4.8750 |
| −0.4000 | 0.6077 | 4.8750 |
| −0.3586 | 0.6223 | 4.8750 |
| −0.3172 | 0.6323 | 4.8750 |
| −0.2756 | 0.6379 | 4.8750 |
| −0.2341 | 0.6391 | 4.8750 |
| −0.1924 | 0.6359 | 4.8750 |
| −0.1506 | 0.6283 | 4.8750 |

TABLE 1-continued

| X | Y | Z |
|---|---|---|
| −0.1083 | 0.6159 | 4.8750 |
| −0.0652 | 0.5985 | 4.8750 |
| −0.0210 | 0.5754 | 4.8750 |
| 0.0245 | 0.5456 | 4.8750 |
| 0.0715 | 0.5082 | 4.8750 |
| 0.1197 | 0.4623 | 4.8750 |
| 0.1694 | 0.4064 | 4.8750 |
| 0.2204 | 0.3389 | 4.8750 |
| 0.2725 | 0.2585 | 4.8750 |
| 0.3254 | 0.1641 | 4.8750 |
| 0.3791 | 0.0549 | 4.8750 |
| 0.4339 | −0.0700 | 4.8750 |
| 0.4904 | −0.2113 | 4.8750 |
| 0.5498 | −0.3697 | 4.8750 |
| 0.6131 | −0.5458 | 4.8750 |
| 0.6812 | −0.7410 | 4.8750 |
| 0.7545 | −0.9566 | 4.8750 |
| 0.8341 | −1.1950 | 4.8750 |
| 0.8376 | −1.2059 | 4.8750 |
| 0.8407 | −1.2171 | 4.8750 |
| 0.8429 | −1.2282 | 4.8750 |
| 0.8437 | −1.2389 | 4.8750 |
| 0.8433 | −1.2489 | 4.8750 |
| 0.8415 | −1.2586 | 4.8750 |
| 0.8381 | −1.2681 | 4.8750 |
| 0.8332 | −1.2770 | 4.8750 |
| 0.8268 | −1.2853 | 4.8750 |
| 0.8191 | −1.2925 | 4.8750 |
| 0.8104 | −1.2984 | 4.8750 |
| 0.8009 | −1.3031 | 4.8750 |
| 0.7909 | −1.3064 | 4.8750 |
| 0.7806 | −1.3082 | 4.8750 |
| 0.7700 | −1.3084 | 4.8750 |
| 0.7597 | −1.3069 | 4.8750 |
| 0.7500 | −1.3039 | 4.8750 |
| 0.7411 | −1.2994 | 4.8750 |
| 0.7332 | −1.2936 | 4.8750 |
| 0.7259 | −1.2866 | 4.8750 |
| 0.7192 | −1.2783 | 4.8750 |
| 0.7132 | −1.2688 | 4.8750 |
| 0.7078 | −1.2587 | 4.8750 |
| 0.7028 | −1.2484 | 4.8750 |

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A turbine blade having an attachment, a platform extending radially outward from said attachment and an airfoil extending radially outward from said platform, said airfoil having an uncoated profile substantially in accordance with Cartesian coordinate values of X, Y, and Z as set forth in Table 1, carried to three decimal places, wherein Z is a distance measured radially from said platform.

2. The turbine blade of claim 1 wherein said airfoil has manufacturing tolerances of about ±0.030 inches.

3. The turbine blade of claim 1 wherein said airfoil has a coating up to 0.010 inches thick.

4. The turbine blade of claim 3 wherein said coating is a metallic CoNiCrAlY coating with a diffused aluminide overlay.

5. The turbine blade of claim 1 further comprising a plurality of radially extending holes, said holes extending from said attachment, through said platform, and through said airfoil.

6. The turbine blade of claim 5 wherein said plurality of radially extending holes pass a cooling medium through said blade to cool said airfoil.

7. The turbine blade of claim 6 wherein said cooling medium is air or steam.

8. The turbine blade of claim 7 wherein said plurality of holes comprises sixteen holes.

9. An airfoil for a turbine blade, said airfoil having an uncoated profile substantially in accordance with Cartesian coordinate values of X, Y, and Z as set forth in Table 1, carried to three decimal places, wherein Z is a distance measured radially from a platform.

10. The airfoil of claim 9 wherein said airfoil has manufacturing tolerances of about ±0.010 inches.

11. The airfoil of claim 9 wherein said airfoil has a coating up to 0.010 inches thick.

12. The airfoil of claim 11 wherein said coating is a metallic CoNiCrAlY coating with a diffused aluminide overlay.

* * * * *